US006474797B2

(12) United States Patent
Kurata et al.

(10) Patent No.: US 6,474,797 B2
(45) Date of Patent: Nov. 5, 2002

(54) INK SUPPLY SYSTEM AND INK-JET RECORDING APPARATUS

(75) Inventors: Tetsuji Kurata, Kanagawa (JP); Yohji Ara, Kanagawa (JP); Hiroyuki Inoue, Kanagawa (JP); Hideo Fukazawa, Kanagawa (JP); Hirofumi Hirano, Kanagawa (JP); Hiroshi Netsu, Kanagawa (JP); Hideaki Okamoto, Kanagawa (JP); Masaya Uetsuki, Kanagawa (JP); Hiroki Hayashi, Kanagawa (JP); Noriyasu Asaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/839,304

(22) Filed: Apr. 23, 2001

(65) Prior Publication Data

US 2001/0040610 A1 Nov. 15, 2001

(30) Foreign Application Priority Data

Apr. 24, 2000 (JP) ..... 2000-123296

(51) Int. Cl.[7] ..... B41J 2/175
(52) U.S. Cl. ..... 347/85
(58) Field of Search ..... 347/84, 85, 86, 347/87; 222/501

(56) References Cited

U.S. PATENT DOCUMENTS 5,425,478 A * 6/1995 Kotaki et al. ..... 222/501
5,509,140 A 4/1996 Koitabashi et al. ..... 347/86
5,742,311 A 4/1998 Koitabashi et al. ..... 347/86
5,745,137 A 4/1998 Scheffelin et al. ..... 347/85

FOREIGN PATENT DOCUMENTS

JP 11-240180 * 9/1999 ..... B41J/2/175

OTHER PUBLICATIONS

Application No. 08/839,384, filed Apr. 18, 1997.
Application No. 09/840,165, filed Apr. 24, 2001.
Application No.: 09/580,460, filed May 30, 2000.
Application No.: 09/583,570, file May 31, 2000.

* cited by examiner

*Primary Examiner*—Anh T. N. Vo
(74) *Attorney, Agent, or Firm*—Fitzpatrick, Cella, Harper & Scinto

(57) ABSTRACT

An ink-jet recording apparatus, it is possible to assuredly execute replenishment of ink into an ink tank and control of a pressure within the ink tank during ink replenishment by a simple configuration, and reduce the size and the weight of the apparatus, and improve reliability of the apparatus. The ink-jet recording apparatus includes an ink tank for receiving ink from an ink intake, an ink supply unit for receiving ink from a replenishing tank into the ink tank by a negative pressure introduced from a suction port of the ink tank in the inside of the ink tank, and a negative-pressure controller for causing the negative pressure within the ink tank to remain in an ink supply channel from the replenishing tank to the inside of the ink tank, so that the negative pressure within the ink tank does not return to an atmospheric pressure while receiving ink.

9 Claims, 21 Drawing Sheets

INK SUPPLY SYSTEM AND INK-JET RECORDING APPARATUS

BACKGROUND OF THE INVENTION

1. Field of the Invention

The present invention relates to an ink jet recording apparatus including a recording head and an ink tank.

2. Description of the Related Art

Conventional ink jet recording apparatuses include so-called serial-scanning-type apparatuses in which a recording head, serving as recording means, and an ink tank, serving as an ink container, are exchangeably mounted on a carriage movable in a main scanning direction. In this recording method, an image is sequentially recorded on a recording medium by repeating main scanning by the carriage on which the recording head and the ink tank are mounted, and sub-scanning on the recording medium.

This recording method can record an image on a large-size recording medium, such as an A1 or A0 size sheet, by providing the carriage with a large moving width. However, since an image is recorded using a large amount of ink on a large sheet, the amount of ink accommodation of the ink tank must be increased, resulting in an increase in the weight and inertia of the entire carriage, and, as a result, an increase in the force needed to move the carriage. In order to move the carriage at a high speed, it is necessary to provide a high-output carriage driving motor having large driving power, resulting in an increase in the cost of the entire recording apparatus. In accordance with an increase in the weight of the entire carriage, a force for decelerating the carriage to a stopped position such as when the carriage changes direction in reciprocating main scanning also increases, and the entire recording apparatus vibrates in reaction to that force. Accordingly, it is difficult to realize a high moving speed of the carriage.

On the other hand, when reducing the amount of ink accommodation of the ink tank in order to reduce the weight of the carriage, the frequency of exchange of the ink tank increases. In some cases, the ink tank must be exchanged in the midst of a recording operation.

A technique described in Japanese Patent Application Laid-Open (Kokai) No. 9-24698 (1997) has been proposed as a solution for solving the above-described problems relating to exchange of the ink tank. In this known technique, a closed bag-type ink container is connected to a recording head. By connecting an auxiliary ink container to the bag-type ink container whenever necessary, ink is replenished from the auxiliary ink container to the bag-type ink container. The bag-type ink container includes a bag for accommodating ink, and accommodates ink within the bag under a negative pressure having a value sufficient to prevent leakage of ink from ink discharging ports of the recording head. Ink is replenished from the auxiliary ink container to the bag-type ink container using the negative pressure in the bag.

The bag in the bag-type ink container is pressed in accordance with the amount of ink discharge of the recording head, i.e., in accordance with the amount of use of ink, to reduce its volume. When the volume of the bag decreases to a value equal to or less than a predetermined amount, a tap of a supply port provided at the bag-type ink container is opened to connect the supply port to the auxiliary ink container. As a result, ink is replenished from the auxiliary ink container into the bag due to the negative pressure within the bag. When the amount of ink accommodated within the bag has a maximum value, the negative pressure within the bag becomes "0", so that replenishment of ink is automatically stopped. According to this known technique, replenishment of ink can be automatically stopped using the negative pressure without requiring control using a pressure sensor, a volume detection sensor, or the like.

The upper limit of the negative pressure in the bag-type ink container is determined in consideration of an ink discharging force when the recording head discharges ink, because when the negative pressure is too large, the ink discharging force of the recording head decreases due to the negative pressure, resulting in faulty ink discharge. Accordingly, it is necessary to determine the negative pressure within a range of good ink discharging conditions in the recording head. It is also necessary to set the head position of ink in the auxiliary ink container to a position lower than the head position of ink in the bag-type ink container. If the difference between the head positions of the two containers is too large, it is impossible to replenish ink even if the negative pressure in the bag-type ink container is determined in accordance with the ink discharging conditions of the recording head.

Accordingly, in this known technique, a special device is provided in order to set the position of the auxiliary ink container in the vertical direction with respect to the bag-type ink container. However, provision of such a device causes the problem that the size and the cost of the entire recording apparatus increase. Furthermore, if air enters an ink channel connecting the auxiliary ink container and the bag-type ink container during replenishment of ink, the air moves into the bag of the bag-type ink container, to greatly reduce the amount of ink accommodation of the bag-type ink container. In addition, if the amount of penetration of air is large, the bag within the biased-bag-type ink container is filled with the air, resulting in incapability of ink replenishment. Another problem is that, since the bag-type ink container is configured by an elastic bag material for forming the bag, and movable members, such as a spring member for inflating the bag, and the like, there is a limitation in reduction of the size, thereby causing complexity in the structure, an increase in the weight, and an increase in the production cost.

SUMMARY OF THE INVENTION

It is an object of the present invention to address the above-described problems in the known technique, while reducing the size and the weight of an ink jet recording apparatus and improving its reliability.

According to one aspect, the present invention which achieves these objectives relates to an ink-jet recording apparatus including an ink tank for receiving ink from an ink intake, ink supply means for receiving ink from a replenishing tank into the ink tank by a negative pressure introduced from a suction port of the ink tank in the inside of the ink tank, and negative-pressure control means for causing the negative pressure within the ink tank to remain in an ink supply channel from the replenishing tank to the inside of the ink tank, so that the negative pressure within the ink tank does not return to an atmospheric pressure while receiving ink.

In one embodiment, the negative-pressure control means includes sealing means, provided within the ink tank, for sealing the ink supply channel with a predetermined negative pressure value.

In another embodiment, the sealing means includes a spring or an elastic member.

According to another aspect, the present invention which achieves these objectives relates to an ink-jet recording apparatus including an ink tank for receiving ink from an ink intake, ink supply means for receiving ink via an ink supply channel from a replenishing tank to the inside of the ink tank by a negative pressure introduced from a suction port of the ink tank in the inside of the ink tank, connection means, provided between the ink intake of the ink tank and the ink supply channel, capable of being separated from the ink intake, and negative-pressure control means for causing the negative pressure within the ink tank to remain in the ink supply channel, so that the negative pressure within the ink tank does not return to an atmospheric pressure while receiving ink.

In one embodiment, the negative-pressure control means includes sealing means, provided within the ink tank, for sealing the ink supply channel with a predetermined negative pressure value.

In another embodiment, the negative-pressure control means includes sealing means, provided at the connection means, for sealing the ink supply channel with a predetermined negative pressure value.

In still another embodiment, the sealing means includes a spring or an elastic member.

In yet another embodiment, the apparatus also includes gas-liquid separation means, provided at the suction port, for allowing a gas permeate without allowing passing ink to permeate.

In yet a further embodiment, the gas-liquid separation means is one of a tetrafluoroethylene resin and a similar porous resin material which allows a gas to permeate without allowing a liquid to permeate.

According to still another aspect, the present invention which achieves these objectives relates to an ink supply system including a stationary ink tank for storing ink to be supplied to a recording head, including an ink reservoir, which performs scanning parallel to a recording medium whenever necessary, and an ink supply channel for connecting the ink tank to the ink reservoir, and suction means for producing negative pressure in the inside of the ink reservoir of the recording head. The ink supply channel is connected to the ink reservoir of the recording head during ink supply, and ink is supplied from the ink tank to the ink reservoir of the recording head via the ink supply channel by suctioning the inside of the ink reservoir by the suction means. The system also includes an opening/closing mechanism for closing a communicating state between the ink supply channel and the ink reservoir before a negative pressure state within the ink reservoir returns to an atmospheric pressure by replenishment of ink.

The foregoing and other objects, advantages and features of the present invention will become more apparent from the following description of the preferred embodiments taken in conjunction with the accompanying drawings.

DESCRIPTION OF THE PREFERRED EMBODIMENTS

An ink jet recording apparatus according to the present invention will now be described with reference to the drawings.

Figure 1:
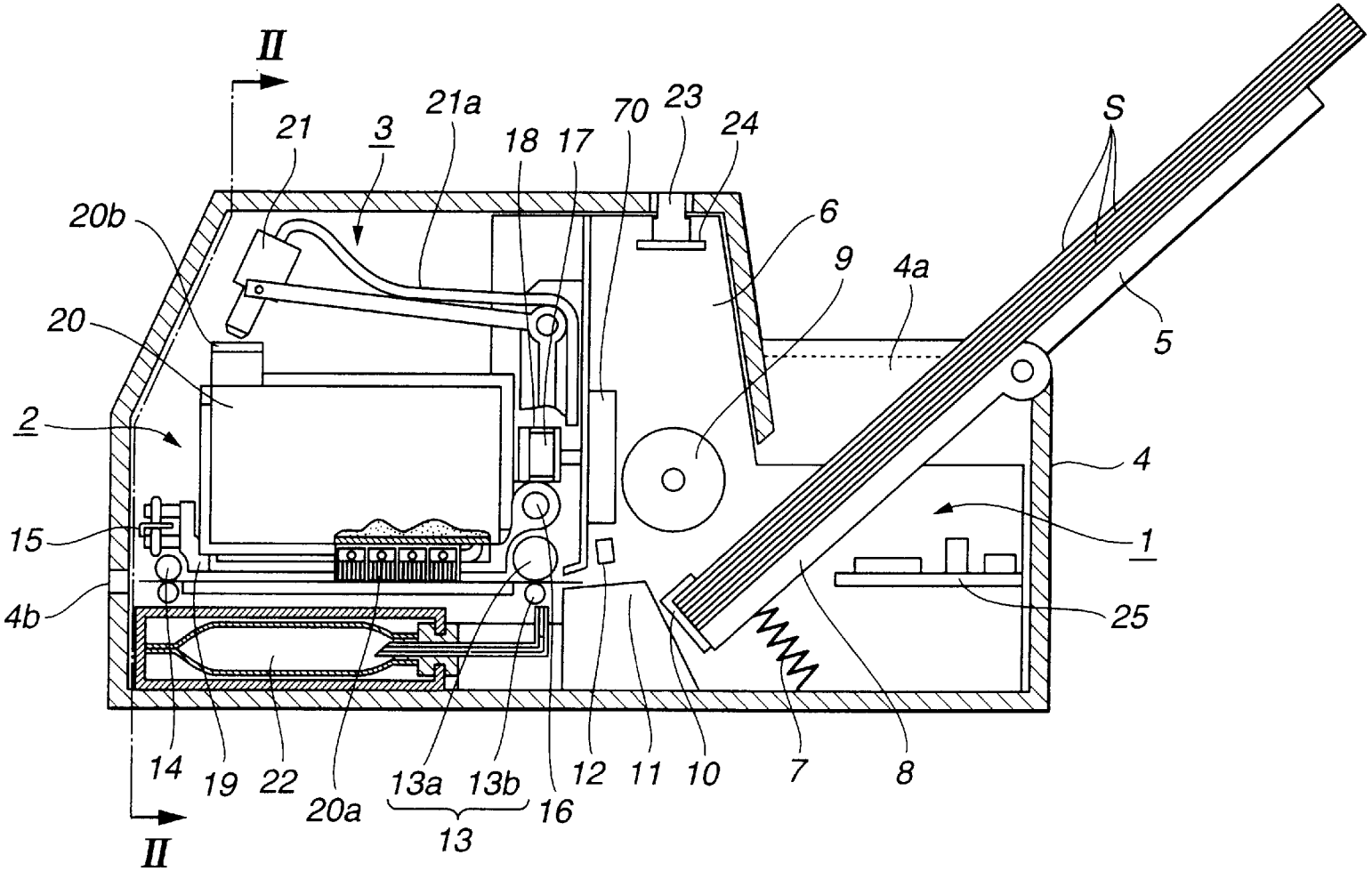
FIG. 1 is a cross-sectional view illustrating a recording apparatus according to the present invention.
Figure 2:
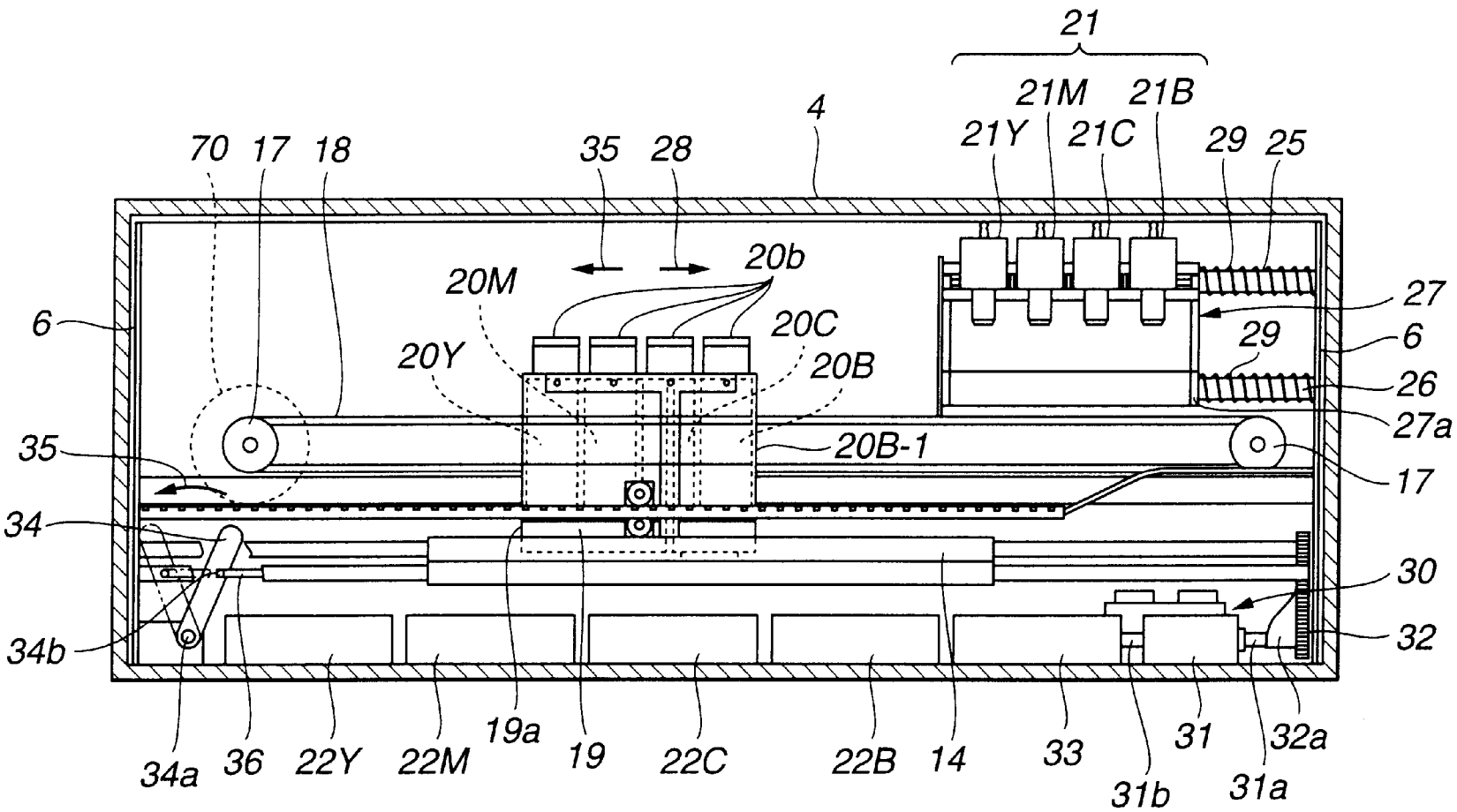
FIG. 2 is a cross-sectional view taken along line II—II shown in FIG. 1.

FIGS. 1 and 2 are diagrams illustrating the entirety of an ink jet recording apparatus according to the present invention. The ink jet recording apparatus shown in FIGS. 1 and 2 is a serial-scanning-type apparatus in which a recording head moves in a main scanning direction.

In FIG. 1, the main body of the recording apparatus includes a sheet feeding unit 1 for feeding a recording medium S, a recording unit 2 for performing recording, an ink replenishing unit 3 for replenishing ink, and a cap unit 30 (see FIG. 6), and the like. A description will now be provided separately for the sheet feeding unit 1, the recording unit 2 and the ink replenishing unit 3.

(Configuration of the Sheet Feeding Unit 1)

In the sheet feeding unit 1, a cover 4 is provided at an outer side of the main body of the apparatus, and sheets of the recording medium S are mounted on a sheet mount 5. Each sheet of the recording medium S is inserted from an insertion port 4*a* provided in the cover 4, and is discharged from a discharging port 4*b*. A mount 8, a feeding roller 9 and a guide member 11 are disposed within a side plate 6 provided within the cover 4. The mount 8 serves as means for mounting sheets of the recording medium S, and is urged toward the feeding roller 9 provided above by a spring 7. The feeding roller 9 serves as feeding means, and contacts the uppermost sheet of the recording medium S on the mount 8. The guide member 11 guides a sheet of the recording medium S separated by separation means 10 toward the recording unit 2.

(Configuration of the Recording Unit 2)

In the recording unit 2, a photosensor 12 detects the recording sheet S passing through a portion downstream from the guide member 11. A pair of rollers 13, i.e., 13*a* and 13*b*, conveys the fed recording medium S at a constant speed. A pair of discharging rollers 14 discharges the recording medium S after image recording. A carriage 19 is movably guided by guide members 15 and 16 in main scanning directions (in directions of the width of the recording medium S) indicated by arrows 28 and 35 shown in FIG. 2. The carriage 19 is moved in the main scanning directions by a driving force transmitted from a carriage motor 70 via a belt 18 stretched between pulleys 17, 17. A storage ink tank 20 is exchangeably mounted on the carriage 19. A recording head 20*a*, serving as image forming means, discharges ink within the storage ink tank 20 based on image information. In this configuration, the storage ink tank 20 and the recording head 20*a* constitute an integrally connected ink jet cartridge. The storage ink tank 20 and the recording head 20*a* may be separately provided and detachably connected, or may be individually mounted on the carriage 19.

As shown in FIG. 2, the storage ink tank 20 of the invention includes an ink tank 20Y for yellow ink, an ink tank 20M for magenta ink, an ink tank 20C for cyan ink, and an ink tank 20B for black ink, for respective colors of accommodated ink liquids. An ink inlet 20*b* for receiving ink is provided at each of the ink tanks 20Y, 20M, 20C and 20B. The ink inlet 20*b* is made of a flexible valve member, such as rubber or the like.

Figure 6:
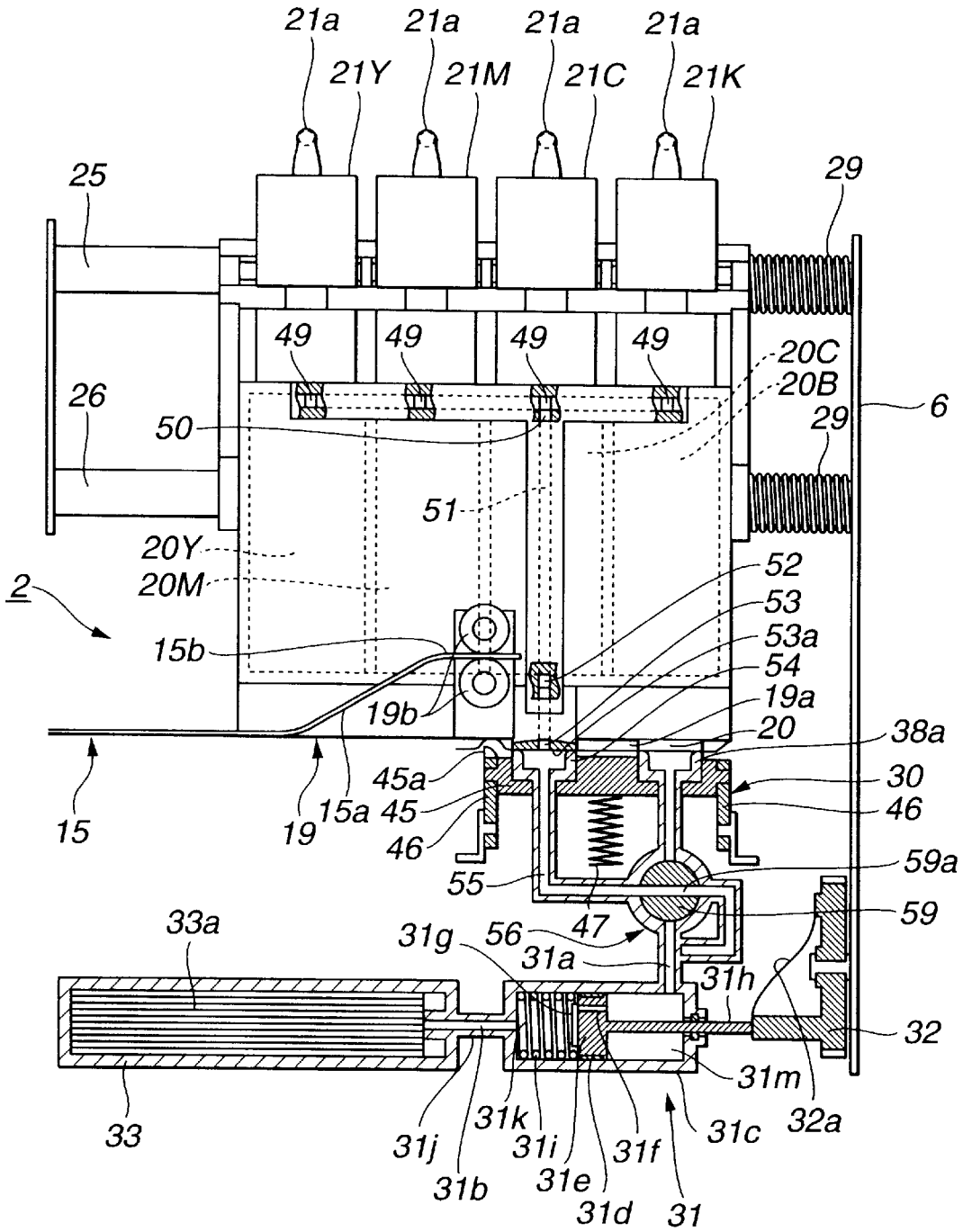
FIG. 6 is a cross-sectional view illustrating an air suction system while ink is replenished to the storage ink tank shown in FIG. 3.
Figure 7:
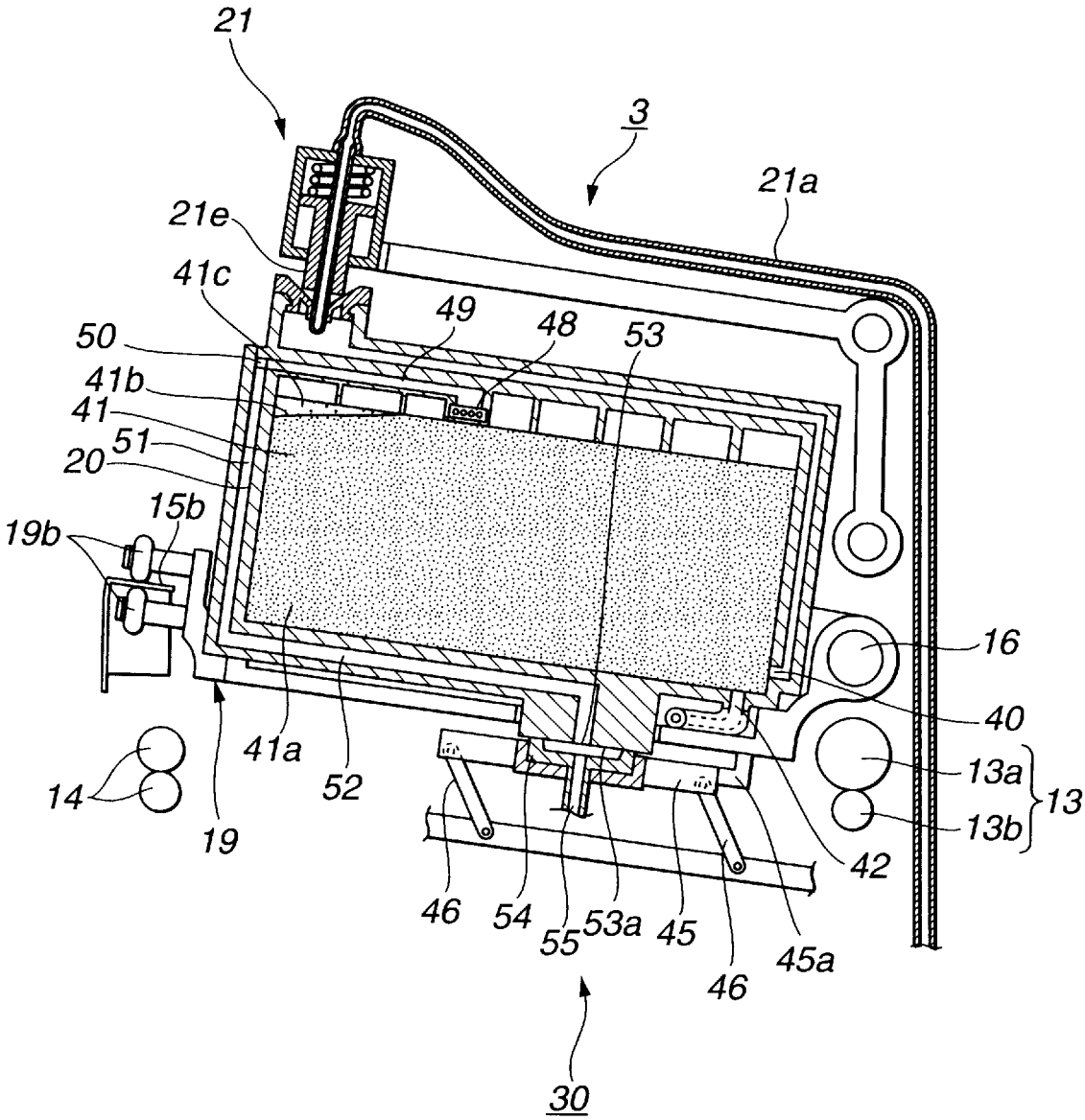
FIG. 7 is a cross-sectional view when ink is supplied from the storage ink tank shown in FIG. 3.

A gas permeation member 48 (see FIG. 4) is provided at a suction port of each of the ink tanks 20Y, 20M, 20C and 20B, and operates as gas-liquid separation means for allowing a gas to permeate without allowing ink to permeate. For example, the gas permeation member 48 (see FIG. 4) is a thin sheet made of a tetrafluoroethylene resin or a similar porous resin material. As shown in FIGS. 6 and 7, a path 55 for discharging air within each of the ink tanks 20Y, 20M, 20C and 20B communicates with a general suction port 53 via a corresponding gas permeation member 48 (see FIG. 4) and ventilation channel 49, and common ventilation channels 50, 51 and 52. As will be described later, air within the ink tanks 20Y, 20M, 20C and 20B is sucked from a cap member 54 in tight contact with a surface 53*a* where the general suction port 53 is opened, via a ventilation tube 57 by a suction pump 31.

The recording head 20*a* includes a plurality of independent head units for respective colors, and each of the head units includes a liquid chamber 43 communicating with a liquid channel 42 of a corresponding one of the ink tanks 20Y, 20M, 20C and 20B, and a plurality of ink discharging nozzles 44. The nozzles 44 include a communicating channel 43 communicating with an ink discharging port, and discharging-energy generation means (not shown) for generating energy for discharging ink from the ink discharging port.

Thus, each ink tank communicates with respective nozzles from which ink can be suctioned by a first cap member 54 so as to maintain good ink discharge condition, and also communicates with common suction port 53 shared by all ink tanks and from which air can be suctioned by a second cap member 38*a* so as to replenish ink in the tank.

(Configuration of the Ink Replenishment Unit 3)

In the ink replenishment unit 3, ink supply means 21 communicates with a replenishing ink tank 22 via a tube 21*a*. The ink supply means 21 replenishes ink from the replenishing ink tank 22 into the storage ink tank 20 by being tightly connected to an ink intake 20*b* of the storage ink tank 20.

As shown in FIG. 2, the replenishing ink tank 22 of the invention includes an ink tank 22Y for yellow ink, an ink tank 22M for magenta ink, an ink tank 22C for cyan ink, and an ink tank 22B for black ink, for respective colors of accommodated ink liquids. The ink tanks 22Y, 22M, 22C and 22B are connected to ink supply means 21Y, 21M, 21C and 21B for corresponding ink colors, respectively, via corresponding tubes 21*a*.

As shown in FIG. 2, the ink supply means 21 is mounted on a moving mount 27. The moving mount 27 is movable in horizontal directions in FIG. 2 by being guided by guide members 25 and 26. When the carriage 19 moves in the direction of the arrow 28 and a side surface 20B-1 of the storage ink tank 20B contacts an arm portion 27*a* of the moving mount 27, the moving mount 27 moves in the direction of the arrow 28 as one body with the carriage 19 against the force of a spring 29.

Figure 3:
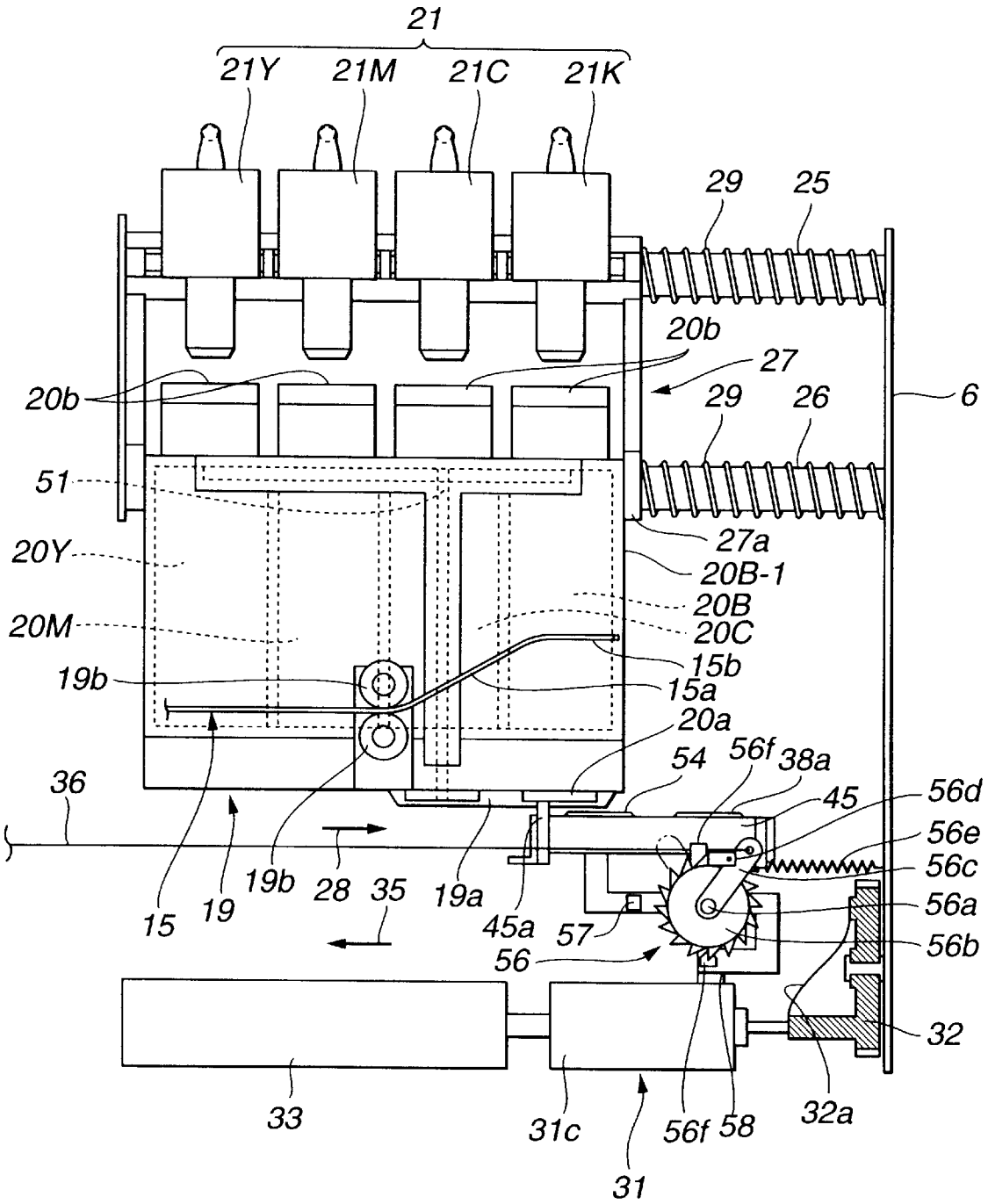
FIG. 3 is an enlarged front view illustrating a surrounding portion of a storage ink tank shown in FIG. 2.
Figure 5:
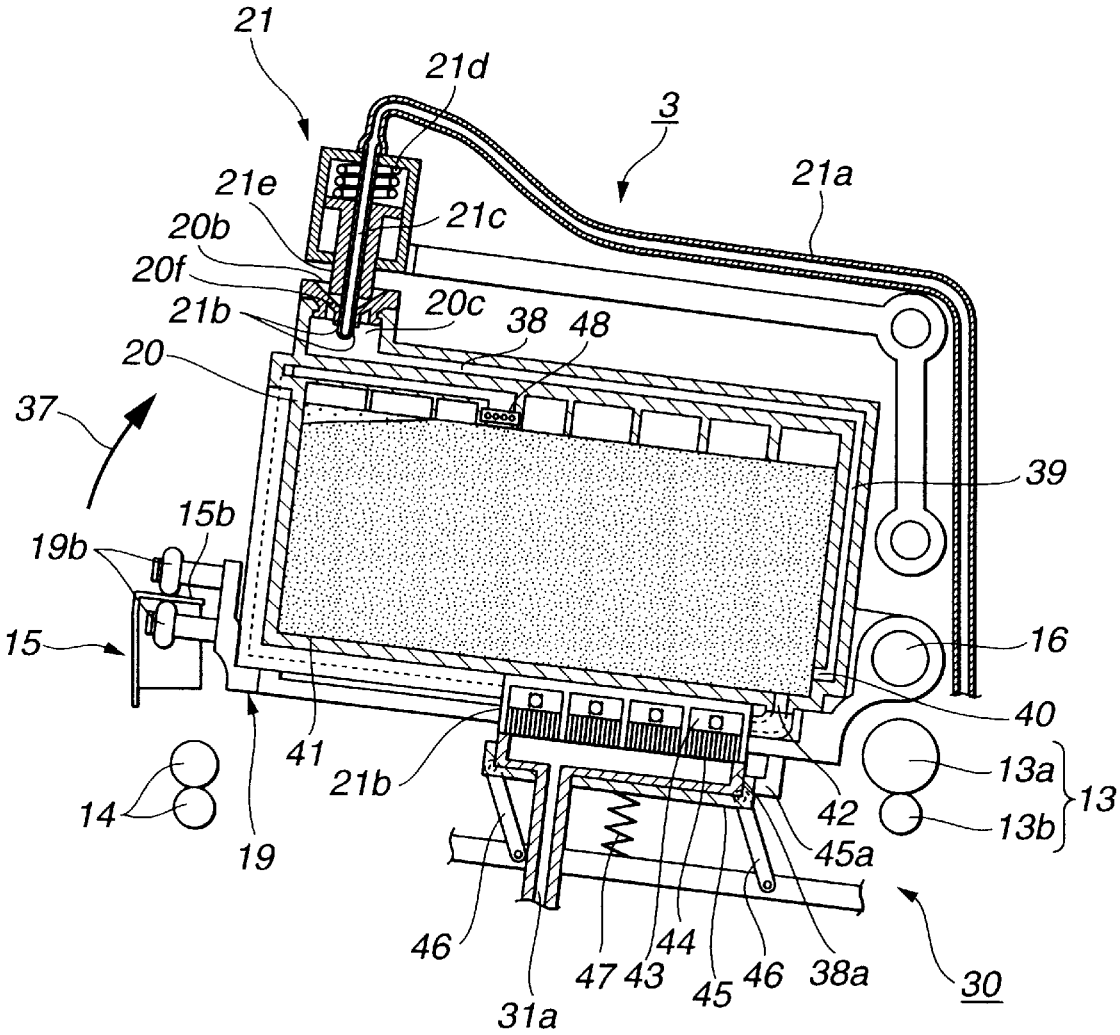
FIG. 5 is a cross-sectional view when the storage ink tank shown in FIG. 3 is inclined.

By moving in the direction of the arrow 28, the carriage 19 rotates, as shown in FIG. 5, in the direction of an arrow 37 around the guide member 16. By this rotation of the carriage 19, the ink supply means 21 and the ink inlet 20*b* of the storage ink tank 20 are connected. That is, as shown in FIG. 3, a pair of guide rollers 19*b*, 19*b* for supporting the carriage 19 with respect to the guide member 15 is mounted on the carriage 19. By the movement of the carriage 19 in the direction of the arrow 28, a side surface 20B-1 of the storage ink tank 20B contacts the arm portion 27*a* of the moving mount 27. After the moving mount 27 starts to move in the direction of the arrow 28 together with the carriage 19, the pair of guide rollers 19*b*, 19*b* moves from an inclined portion 15*a* to a horizontal portion 15*b* of the guide member 15. As a result, as shown in FIG. 5, the carriage 19 rotates in the direction of the arrow 37 around the guide member 13, and the ink supply means 21 and the ink intake 20*b* of the storage ink tank 20 are connected.

Figure 4:
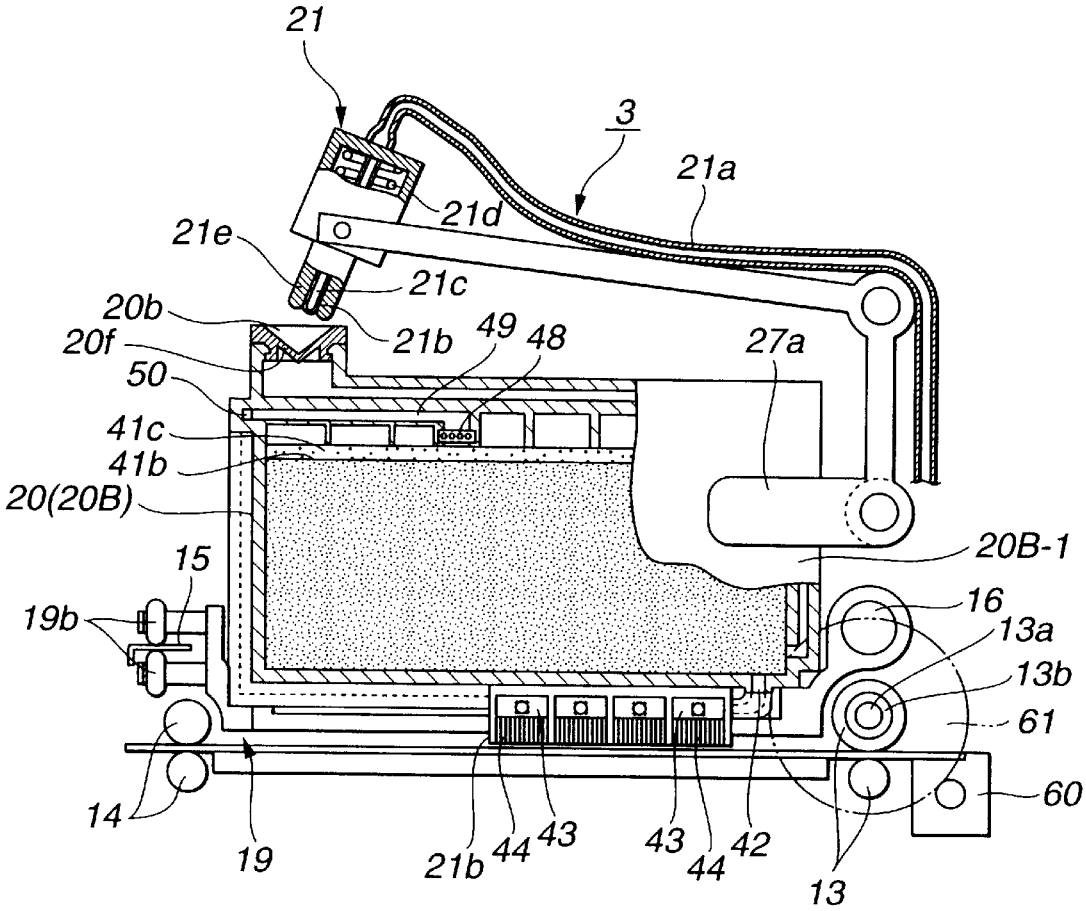
FIG. 4 is a cross-sectional view of the storage ink tank shown in FIG. 3.

As shown in FIGS. 4 and 5, a hollow needle 21*c* whose distal end is closed is provided at the ink supply means 21, and a fine hole 21*b* threaded in a horizontal direction in FIG. 5 is formed at the distal end of the hollow needle 21*c*. A piston-shaped plug member 21*e* movable in vertical directions in FIG. 5 having the same axis as the hollow needle 21*c* is provided at an outer circumferential portion of the hollow needle 21*c*. The plug member 21*e* is made of a flexible material, such as rubber or the like, and is urged downward by a spring 21*d*.

As shown in FIG. 4, before the ink supply means 21 is connected to the ink inlet 20*b* of the storage ink tank 20, the fine hole 21*b* of the hollow needle 21*c* is blocked by being covered by the plug member 21*e*. Accordingly, at that time, ink is not leaked from the hollow needle 21*c*. In this state, as shown in FIG. 4, the ink intake 20*b* of the storage ink tank 20 comprising a flexible member, such as rubber or the like, is closed by the restoring force of the valve member 20*f*.

On the other hand, as shown in FIG. 5, when the ink supply means 21 is connected to the ink intake 20*b* of the storage ink tank 20, the upper surface of the ink intake 20*b* tightly contacts the lower surface of the plug member 20*e*. Furthermore, the plug member 21*e* retracts upward against the force of the spring 21*d*, so that the fill hole 21*b* of the hollow needle 21*c* is opened at an inside 20*c* of the ink intake 20*b*. As a result, ink flowing from the fill hole 21*b* passes through liquid channels 38, 39 and 40, and is absorbed into a sponge-like ink absorbing member 41 within the storage ink tank 20.

(Configuration of the Cap Unit 30)

The cap unit 30 tightly contacts the recording head 20*a*, and sucks air remaining in the liquid chambers 43 and the nozzles 44 and viscous ink, i.e., foreign matter that might otherwise cause a failure in ink discharge. In FIG. 5, a cap member 38*a* covers a surface of the recording head 20*a* where ink discharging ports are formed (ink-discharging-port forming surface). A cap member 54 tightly contacts the surface 53*a* where the general suction port 53 is opened. These cap members 38*a* and 54 are held on a frame 45. The frame 45 is supported by four link arm member 46 so as to be movable in vertical directions. A spring 47 urges the frame 45 upward. Conduits 30*b* and 55 are connected to the cap members 30*a* and 54, respectively. A switching mechanism 56 for a pumping channel is connected to the conduits 30*b* and 55.

(Switching Mechanism 56 for the Pumping Channel)

A projection 45*a* positioned on a moving locus of a bank portion 19*a* provided at a fixed position of the carriage 19 is provided at one end of the frame 45. When the bank portion 19*a* contacts the projection 45*a* at a moved position of the carriage 19, then, as shown in FIG. 6, the frame 45 is depressed against the spring 47, so that the ink-discharging-port forming surface of the recording head 20*a* and the surface 53*a* where the general suction port 53 is formed pass above the cap members 38*a* and 54 without contacting them. On the other hand, when the bank portion 19*a* leaves the projection 45*a*, then, as shown in FIG. 6, the frame 45 is raised by the spring 47, so that the cap member 38*a* contacts the ink-discharging-port forming surface of the recording head 20*a*, and the cap member 54 tightly contacts the surface 53*a* where the general suction port 53 is formed.

As shown in FIG. 6, the switching mechanism 56 to which the conduits 30*b* and 55 are connected includes a rotary valve 59 made of rubber or the like. The rotary valve 59 selectively connects the conduit 30*b* or 55 to a pump suction port 31*a* of the suction pump 31 via a communicating channel 59*a*, in accordance with a position of rotation which changes by 90 degrees. The rotary valve 59 is fixed on a rotation shaft 56*a* shown in FIG. 3. A saw-tooth gear 56*b* is fixed on the rotation shaft 56*a*, and an end portion of an arm member 56*c* is rotatably supported on the rotation shaft 56*a*. A ratchet tooth 56*d* meshing with the saw-tooth gear 56*b* only in one direction is rotatably supported on the arm member 56*c*. A spring 56*e* urges the arm member 56*c* in a clockwise direction in FIG. 3. Two position indicating members 56*f* are provided at the saw-tooth gear 56*b* with an angle difference of 180 degrees. Position detectors 57 and 58 for detecting the position indicating members 56*f* are provided at fixed positions with an angle difference of 90 degrees. A microswitch, a photosensor or the like is used as each of the position detector 57 and 58.

Figure 8:
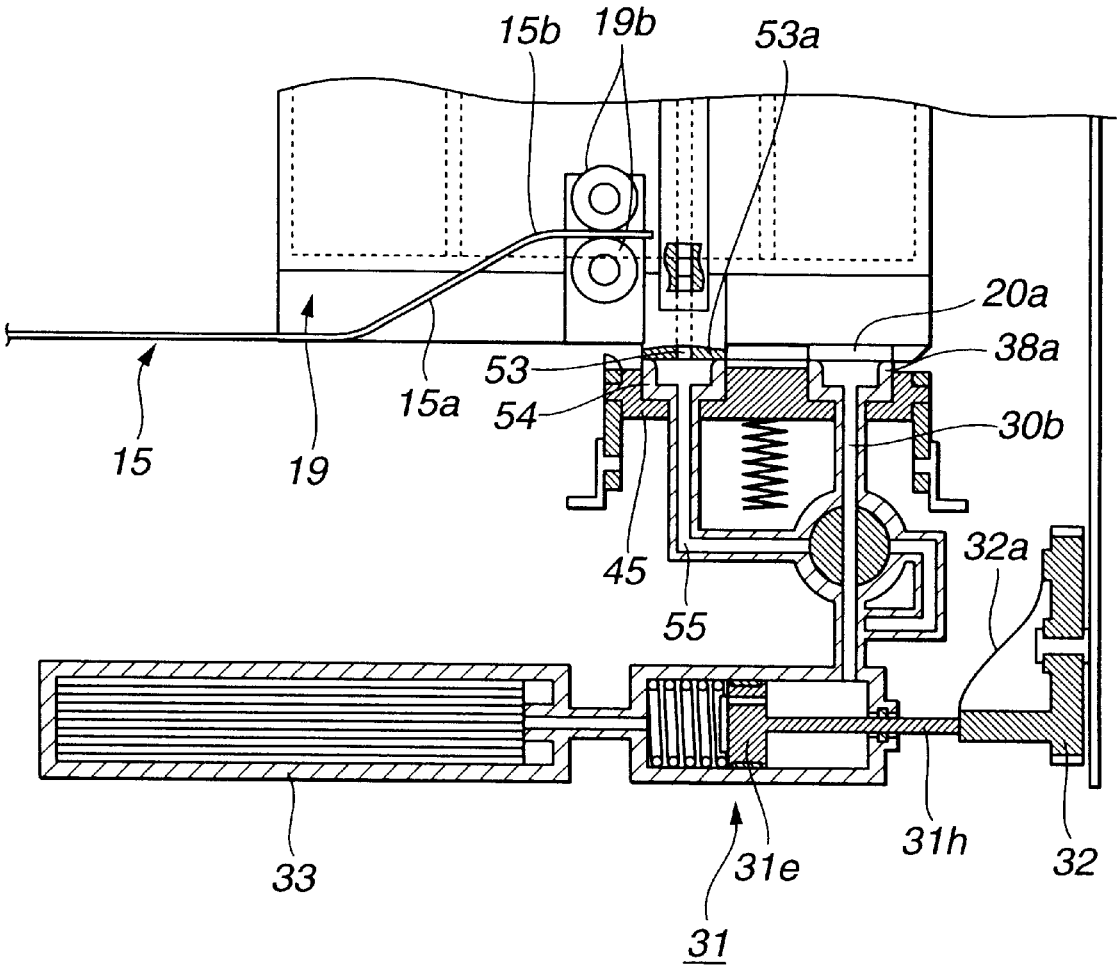
FIG. 8 is a partially broken cross-sectional view of the air suction system during suction recovery for a recording head shown in FIG. 3.

The distal end of the arm member 56*c* is connected to a hole portion 34*b* of a switching lever 34 (see FIG. 2) via a connection shaft 36. An end portion of the switching lever 34 is rotatably supported on a shaft 34*a*. When the carriage 19 moves in the direction of the arrow 35 to contact the distal end of the switching lever 34, and further moves in the direction of the arrow 35, the switching lever 34 is rotated in the direction of the arrow 35 as indicated by two-dot chain lines shown in FIG. 2. Linked with this rotation of the switching lever 34 in the direction of the arrow 35, the arm member 56*c* rotates in a counterclockwise direction in FIG. 3 by 90 degrees against the spring 56*e*. At that time, since the ratchet tooth 56*d* meshes with the saw-tooth gear 56*b*, the saw-tooth gear 56*d* is rotated in a counterclockwise direction by 90 degrees together with the rotation shaft 56*a* and the rotary valve 59. When the carriage 19 is thereafter separated from the distal end of the switching lever 34 in the direction of the arrow 28, the switching lever 34 and the arm member 46*c* are rotated in a clockwise direction by the force of the spring 56*e* to return to the original position. At that time, since the ratchet tooth 56*d* does not mesh with the saw-tooth gear 56*b*, the saw-tooth gear 56*b* is not rotated.

every time the switching lever 34 is rotated in the direction of the arrow 35 by the carriage 19, the rotary valve 59 rotates in a counterclockwise direction by 90 degrees to switch the pumping channel. The switched state of the pumping channel is detected by the position detectors 57 and 58. FIG. 6 illustrates a switched state when the position detector 57 detects the position indicating member 56*f*. At that time, the general suction port 53 communicates with the pump 31 via the cap member 54, the conduit 55, the communicating channel 59*a* and the pump suction port 31*a*. FIG. 8 illustrates a switched state when the position detector 58 detects the position indicating member 56*f*. At that time, the ink discharging ports of the recording head 20*a* communicate with the pump 31 via the cap member 38*a*, the conduit 30*b*, the communicating channel 59*a* and the pump suction port 31*a*. Control means 25 (see FIG. 1, to be described later) detects a switched state of the pumping channel from a detection signal from the position detector 57 or 58. When the switched state of the pumping channel is inadequate for an operation to be executed, the control means 25 moves the carriage 19 in the direction of the arrow 35 to rotate the switching lever 34 in the direction of the arrow 34. Thus, the pumping channel is switched so as to be adapted to the object of the operation.

In FIG. 1, an electric substrate 24 is disposed inside the cover 4, and includes a plurality of switch buttons 23 protruding upward from corresponding holes in the cover 4. The control means 25 includes a microprocessor, a memory and the like which are mounted on an electric substrate for control disposed inside the cover 4. The control means 25 controls the recording apparatus by communicating with a host computer.

(Suction Pump 31)

As shown in FIG. 6, in the suction pump 31, a piston member 31*e* is reciprocatably provided within a cylinder member 31*c* where a suction port 31*a* and a exhaust port 31*b* are formed, via a seal member 31*d*. A lead valve 31*g* for limiting the flow of a fluid only to the leftward direction in FIG. 6 is provided in a fine hole 31*f* provided in the piston member 31*e*. A piston shaft 31*h* drives the piston member 31*e*. A spring member 31*i* urges the piston member 31*e* to the right in FIG. 6. Ink and air sucked by the suction pump 31 passes from the exhaust port 31*b* to an exhaust tube 31*j*, and is discharged toward a sponge-like ink absorber 33*a* within a waste-liquid container 33.

The piston shaft 31*h* reciprocates in horizontal directions in FIG. 6 by following the rotation of a cam portion 32*a* of a cam gear 32 (to be described later). By reciprocating movement of the piston member 31*e* in horizontal directions together with the piston shaft 31*h,* ink and air are sucked from the suction port 31*a,* and are discharged from the exhaust port 31*b.*

As shown in FIG. 4, a gear 61 is mounted on the shaft 13*a* of the conveying roller 13 via a one-way clutch 13*b,* and is rotated by a driving motor 60. By the revolution of the driving motor 60 in a counterclockwise direction, the shaft 13*a* of the conveying roller 13 is rotated. By the revolution of the driving motor 60 in a clockwise direction, the cam gear 32 is rotated. The piston shaft 31*h* is brought in contact with the cam portion 32*a* of the cam gear 32 by the force of the spring 31*i.* The piston shaft 31*h* is moved in horizontal directions by the cam portion 32*a* whose contact position with the piston shaft 31*h* changes in accordance with the rotation of the cam gear 32. The piston member 31*e* reciprocates in horizontal directions together with the piston shaft 31*h.* When the piston member 31*e* moves to the left, the lead valve 31*g* is closed by a pressure generated in a pressure chamber 31*k* at a left portion of the suction pump 31, so that ink and air within the pressure chamber 31*k* are discharged from the exhaust port 31*b* into the waste-liquid container 33. At that time, the volume of a pressure chamber 31*m* at a right portion of the suction pump 31 increases, so that a negative pressure is generated within the pressure chamber 31*m.* Accordingly, ink and air are sucked from the suction port 31*a.* On the other hand, when the piston member 31*e* moves to the right, ink and air within the pressure chamber 31*m* at the right portion of the suction pump 31 move into the pressure chamber 31*k* at the left portion of the suction pump 31 via the fine hole 31*f.*

Next, operations of the apparatus will be described.

(Recording Operation)

In a recording operation, first, a host computer develops image data to be transmitted to the recording unit 2. The control means 25 controls the movement and conveyance of the carriage 19 in the main scanning direction, the conveyance of the recording medium S by the pair of conveying rollers 13 and 14, the recording head 20*a,* and the like. The recording head 20*a* discharges ink droplets of respective colors from the nozzles 44 controlled based on gradation processing of an image (how to superpose color dots), to record a color image on the recording medium S.

When the photosensor 12 detects the trailing edge of the recording medium S, the pair of conveying rollers 14 discharges the recording medium S on which recording has been completed, from the discharging port 4*b* after completion of recording on the trailing edge.

(Recovery Operation)

When the recording operation is interrupted for at least a predetermined time period when turning on a power supply of the recording apparatus or after turning on the power supply of the recording apparatus, the control means 25 automatically starts a recovery operation for removing viscous ink and air bubbles from within the nozzles of the recording head 20*a*. When, for example, unevenness or vanishing in colors occurs in the recorded image, the control means 25 also starts a recovery operation according to depression of operation button 23 (see FIG. 1).

In the recovery operation, the control means 25 first confirms whether or not the position detector 58 in the suction-channel switching mechanism 56 detects the position indicating member 56*f.* When the position indicating member 56*f* is detected by the position detector 57, the switching lever 34 is rotated in the direction of the arrow 35 by moving the carriage 19 in the direction of the arrow 35. Thus, a state in which the position detector 58 detects the position indicating member 56*f,* i.e., a suction-channel switching state as shown in FIG. 8, is provided. After confirming the state in which the position detector 58 detects the position indicating member 56*f,* the control means 25 moves the carriage 19 so that, as shown in FIGS. 7 and 8, the recording head 20*a* contacts the cap member 38*a,* and the general suction port 53 contacts the cap member 54. Then, by causing the motor 60 (see FIG. 4) to revolve in a clockwise direction, the control means 25 rotates the cam gear 32 via the gear 61. The suction pump 31 thereby sucks viscous ink and air within the nozzles of the recording head 20*a,* and discharges the viscous ink and the air into the waste-liquid container 33.

The piston member 31*e* of the suction pump 31 performs a one-cycle operation of suction and exhaust by one rotation of the cam gear 32. The number of rotations of the cam gear 32 is determined in accordance with the value of the negative pressure necessary for recovery of a failure in ink discharge of the recording head 20*a.*

(Ink Replenishing Operation)

The control means 25 counts the number of ink droplets discharged from the recording head 20*a* for each ink color. When at least one of the count values for respective ink colors reaches a predetermined value, recording on the recording medium S during the recording operation is terminated. When the recording medium S on which recording has been terminated is discharged, the control means 25 starts an operation of replenishing ink from the replenishing ink tank 22 (see FIG. 1) into the storage ink tank 20.

In the ink replenishing operation, the control means 25 first confirms whether or not the position detector 57 at the suction-channel switching mechanism 56 detects the position indicating member 56*f.* When the position indicating member 56*f* is detected by the position detector 58, the control means 25 rotates the switching lever 34 in the direction of the arrow 35 by moving the carriage 19 in the direction of the arrow 35. Thus, a state in which the position detector 57 detects the position indicating member 56*f,* i.e., a suction-channel switching state as shown in FIG. 6, is provided. After confirming the state in which the position detector 57 detects the position indicating member 56*f,* the control means 25 moves the carriage 19 so that, as shown in FIGS. 5, 6 and 7, the recording head 20*a* contacts the cap member 38*a,* and the general suction port 54 contacts the cap member 53. Then, by causing the motor 60 (see FIG. 4) to revolve in a clockwise direction, the control means 25 rotates the cam gear 32 via the gear 61. The suction pump 31 thereby sucks air within the storage ink tank 20 via the gas permeation member 48, and discharges the air into the waste-liquid container 33.

By suction of the air within the storage ink tank 20 by the suction pump 31, the pressure within the storage ink tank 20 becomes a negative pressure. At that time, as shown in FIG. 7, the supply means 21 connects the replenishing ink tank 22 (see FIG. 1) to the storage ink tank 20. As a result, ink within the replenishing ink tank 22 is sucked into the inside 41 of the storage ink tank 20 due to the negative pressure within the storage ink tank 20. The ink flowing into the inside 41 of the storage ink tank 20 penetrates into the ink absorbing member 41*a* comprising, for example, a sponge including communicating small cells. A liquid surface 41*b* of the ink rises as the penetration of the ink proceeds. The speed of the rise of the liquid surface 41*b* of the ink is set to an appropriate value in accordance with the amount of rotation of the cam gear 32, because the speed depends on the suction force of the suction pump 31. When the liquid surface 41*b* of the ink reaches the gas permeation member 48, replenishment of the ink is automatically stopped, because the gas permeation member 48 does not allow a liquid, such as ink or the like, to permeate.

Ink is simultaneously replenished to the storage ink tank 20 (20Y, 20M, 20C and 20B) from the corresponding replenishing ink tank 22 (22Y, 22M, 22C and 22B). The replenishment of ink is automatically stopped in the order of the storage ink tank 20 (20Y, 20M, 20C and 20B) where the liquid surface 41*b* of ink reaches the gas permeation member 48.

Thus, it is possible to suck air within the plurality of storage ink tanks 20 (20Y, 20M, 20C and 20B) via the single cap member 54, and simultaneously replenish ink into these storage tanks 20 (20Y, 20M, 20C and 20B). Accordingly, it is unnecessary to provide the suction port 53 and the cap member 54 for each of the storage ink tanks 20 (20Y, 20M, 20C and 20B), and it is possible to reduce the size and the weight of the components of the cap unit 30 at the carriage 19. It is also possible to obtain high reliability in a device for making the pressure within the storage ink tanks 20 (20Y, 20M, 20C and 20B) to be a negative pressure.

During an ink replenishing operation, since the storage ink tank 20 is inclined as shown in FIG. 7, a portion 41*c* where ink is not absorbed is produced in the ink absorbing member 41*a* in the inside 41 of the storage ink tank 20. When the storage ink tank 20 returns to a horizontal position as shown in FIG. 4 after the ink replenishing operation, since ink also penetrates into the portion 41*b,* the liquid surface 41*b* shown in FIG. 7 covering the gas permeation member 48 leaves the surface of the gas permeation member 48 and moves downward. When there is the possibility that the function of the gas permeation member 48 is degraded to allow ink to permeate through it while the gas permeation member 48 always contacts ink, it is effective to separate ink from the surface of the gas permeation member 48 except during an ink replenishing operation, in the above-described manner.

The suction pump 31 of the invention has the function of suction means for sucking ink for a recovery operation for the recording head 20*a,* and the function of suction means for sucking air within the storage ink tank 20 for an ink replenishing operation. Accordingly, it is possible to greatly simplify the configuration and reduce the cost of the entire apparatus than in a case of providing a plurality of suction pumps for these functions. The negative pressure within the storage ink tank 20 during an ink replenishing operation is set to a value so as not to draw ink within the nozzles 44 into the storage ink tank 20, when the ink discharging ports are opened. During an ink replenishing operation, the ink discharging ports may be tightly closed by the cap member.

If air enters from a part of the ink channel between the storage ink tank 20 and the replenishing ink tank 22, it is possible to discharge the air via the gas permeation member 48 and again replenish ink. Ink can be replenished even of there is an ink-head difference between the storage ink tank 20 and the replenishing ink tank 22.

When ink is sucked and replenished without using the gas permeation member 48, if air enters the storage ink tank 20 from the nozzles 44 or the like, it is necessary to again suck ink from the nozzles 44 to discharge the entering air and form an ink meniscus at the ink discharging ports, after an ink replenishing operation. As a result, extra time is required, and useless waste ink is produced. Even if the nozzles 44 are tightly closed using a cap during an ink replenishing operation, if there is a space within the cap, air within the space enters from the nozzles 44 to the storage ink tank 20, thereby causing similar problems.

FIGS. 9–12 are diagrams illustrating the configurations of the storage ink tank 120 and the ink supply means 121 according to the invention.

Figure 9:
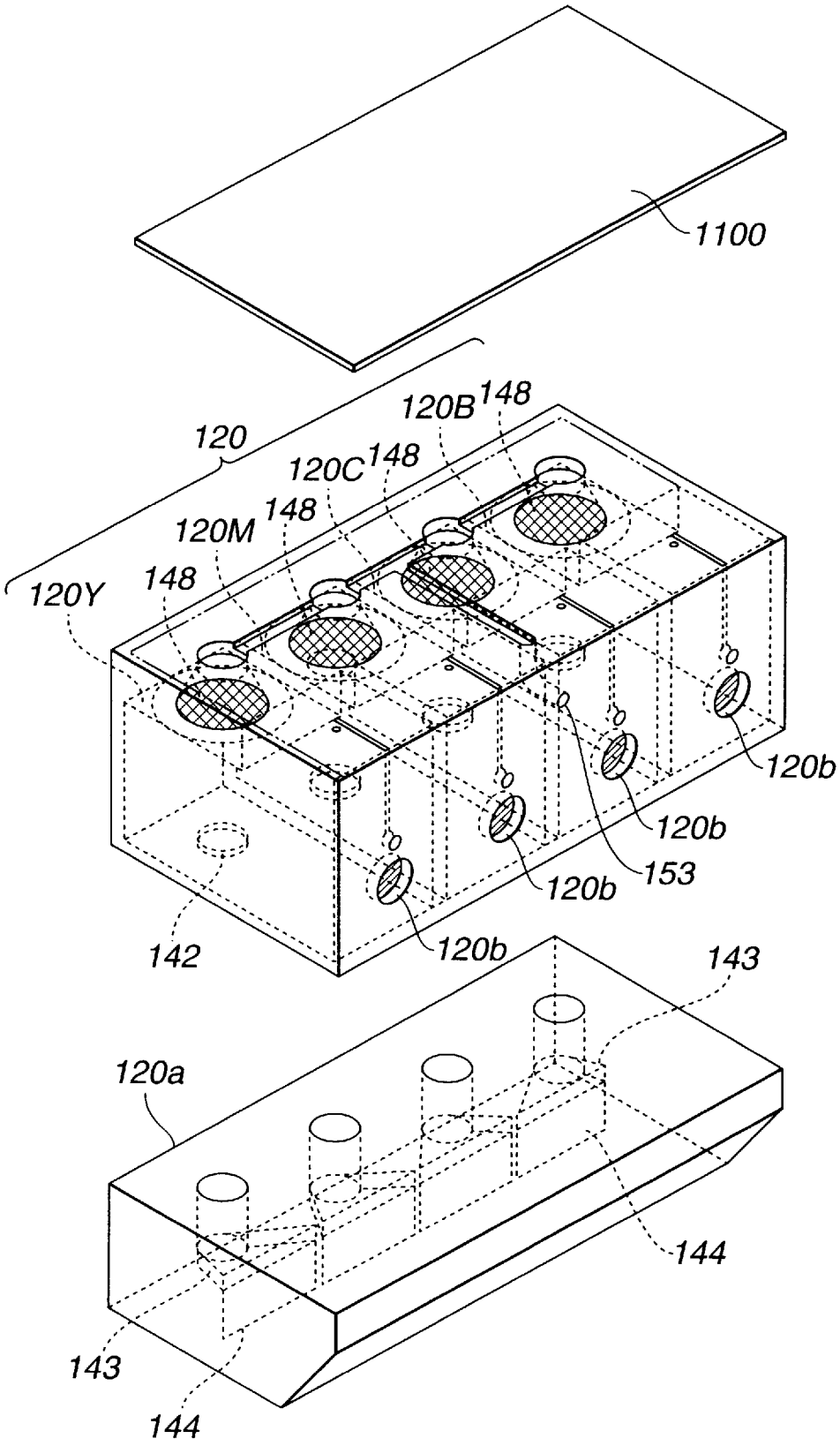
FIG. 9 is an exploded perspective view of the storage ink tank.
Figure 10:
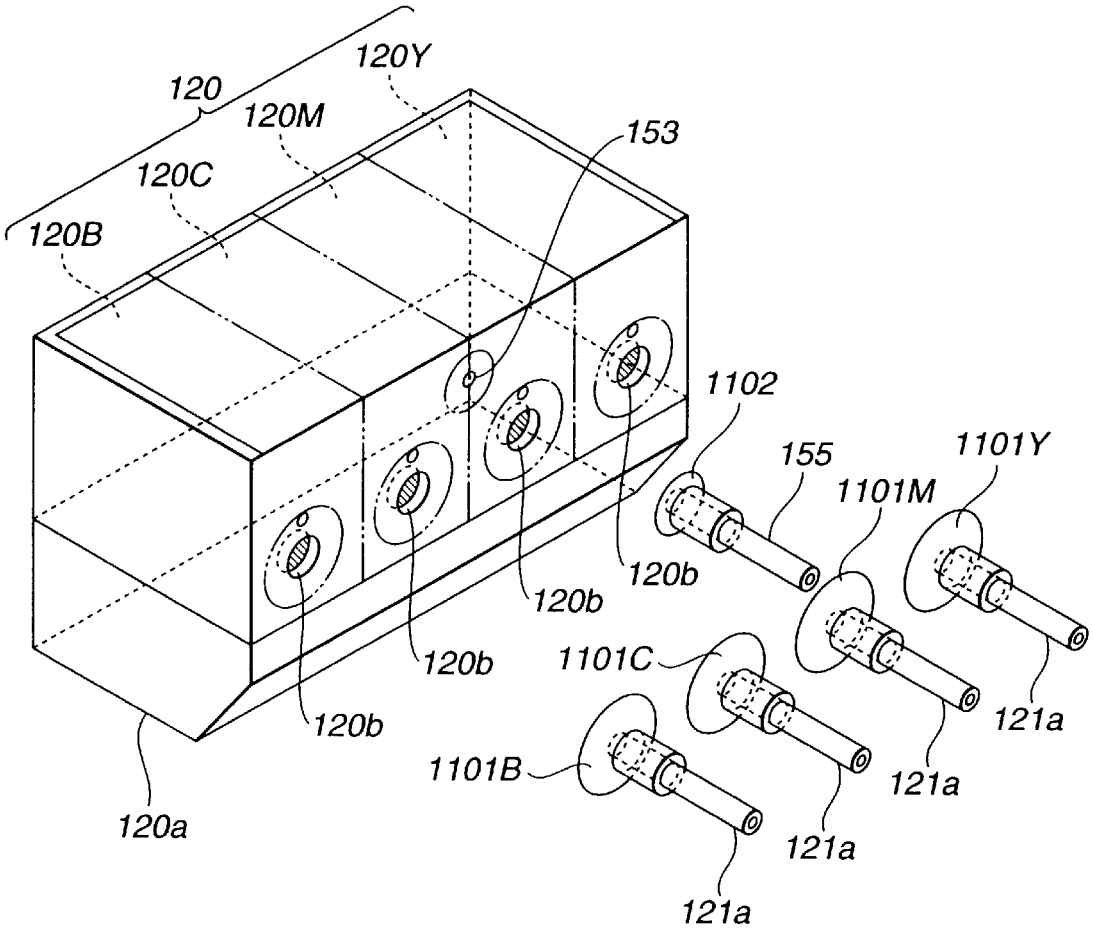
FIG. 10 is a perspective view of the storage ink tank shown in FIG. 9.
Figure 11:
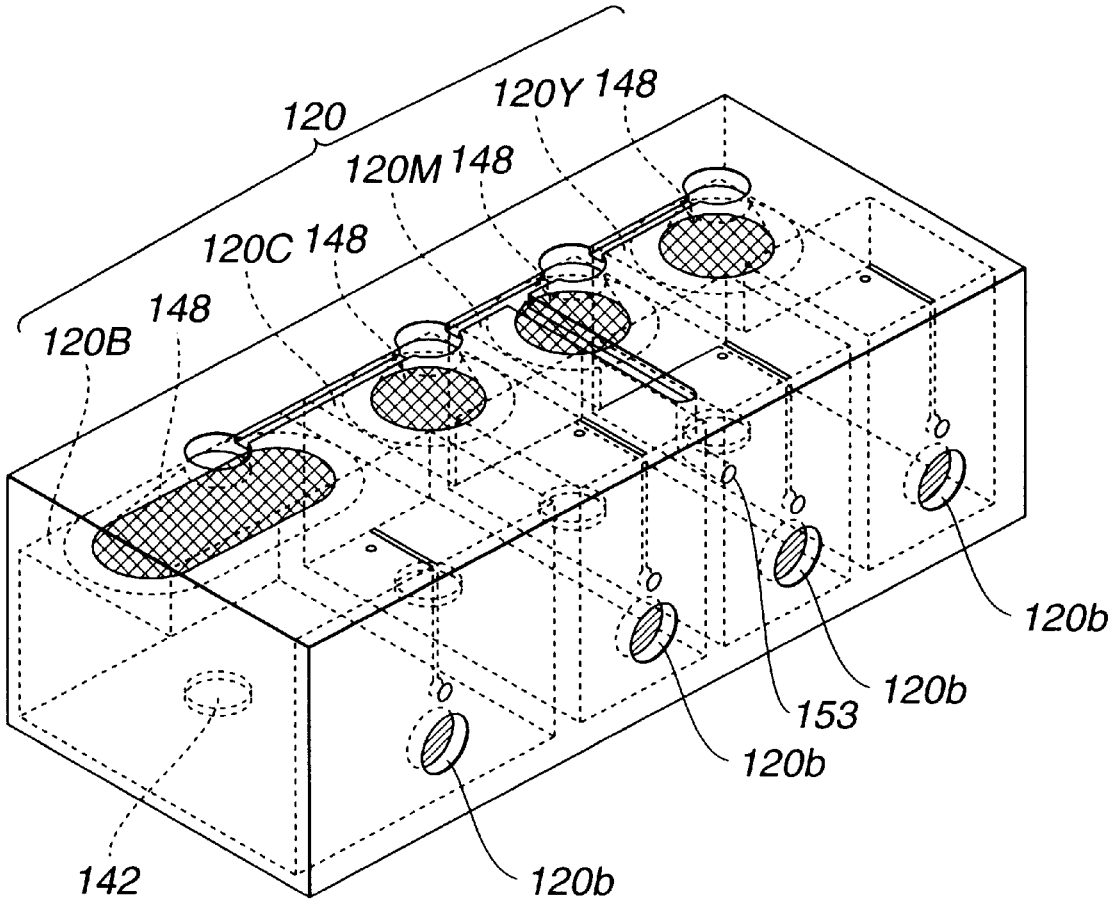
FIG. 11 is a perspective view illustrating a modification of the storage ink tank shown in FIG. 9.

As shown in FIGS. 9 and 10, the general suction port 153 and the ink inlets 120*b* are formed on a side surface of the storage ink tank 120. An air discharging channel between the respective ink tanks 120Y, 120M, 120C and 120B and the general suction port 153 is formed by a groove on the upper surface of the main body of the storage ink tank 120, and a cover member 1100 connected to the upper surface of the main body. The above-described gas permeation member 148 is provided at each of the ink tanks 120Y, 120M, 120C and 120B. The above-described recording head 120*a* is connected to the storage ink tank 120. FIG. 11 illustrates a case in which the ink tank 120B for black ink has a larger volume than the other ink tanks 120Y, 120M and 120C. In this case, the gas permeation member 148 for the ink tank 120B is larger than other ones. Replenishment of black ink is accelerated by smoothly sucking air within the ink tank 120B via the relatively large gas permeation member 148.

In FIG. 10, supply joints 1101Y, 1101M, 1101C and 1101B are connectable to corresponding ink intakes 120*b* of the ink tanks 120Y, 120M, 120C and 120B, respectively, and are connected to corresponding ones of tubes 121*a* as the above-described supply means 121Y, 121M, 121C and 121B. A suction joint 1102 is connectable to the general suction port 153, and is connected to the conduit 155 as the above-described cap member 154.

Figure 12:
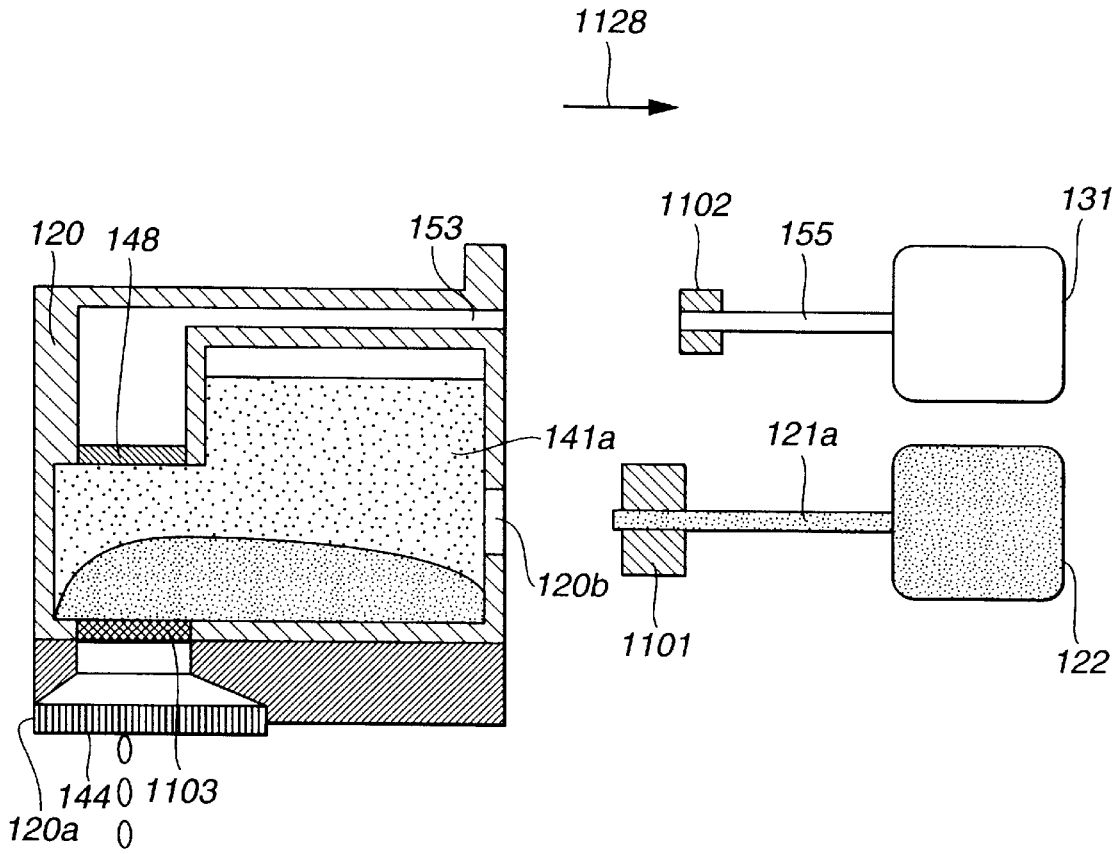
FIG. 12 is a schematic diagram illustrating the configuration of an ink replenishing system to be connected to the storage ink tank shown in FIG. 9.

FIG. 12 is a diagram illustrating the positional relationship between the storage ink tank 120 at the carriage 119 and the joints 1101 (1101Y, 1101M, 1101C and 1101B) and 1102 at the main body of the apparatus. The ink intakes 120*b* and the general suction port 153 are connected to the corresponding joint 1101 and the joint 1102, respectively, by the movement of the carriage 119 in the direction of the arrow 128. In FIG. 12, the configurations of an ink supply system between the supply joint 1101 and the replenishing ink tank 122, and a suction system between the suction joint 1102 and the suction pump 131 are shown by being simplified. Reference numeral 1103 represents a filter provided in a liquid channel 42.

FIGS. 13 through 17 illustrate an ink replenishing operation.

Figure 13:
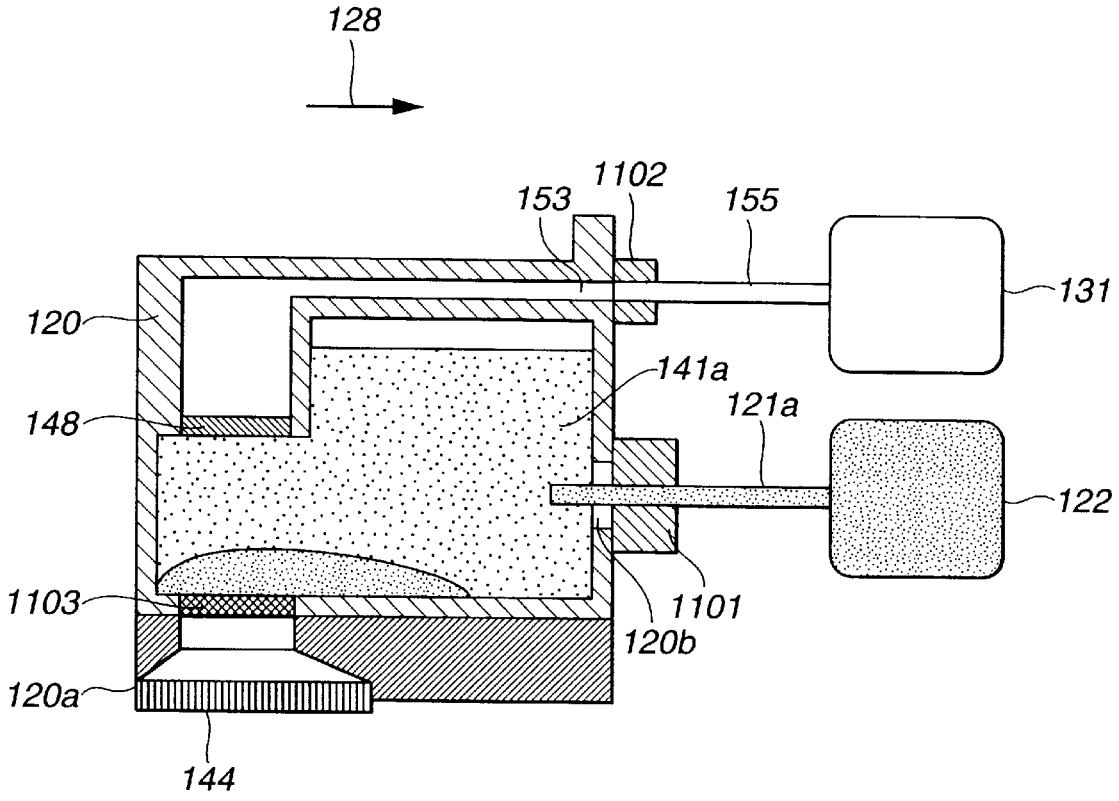
FIG. 13 is a diagram illustrating a state of connection of the ink replenishing system shown in FIG. 12 to the storage ink tank.
Figure 14:
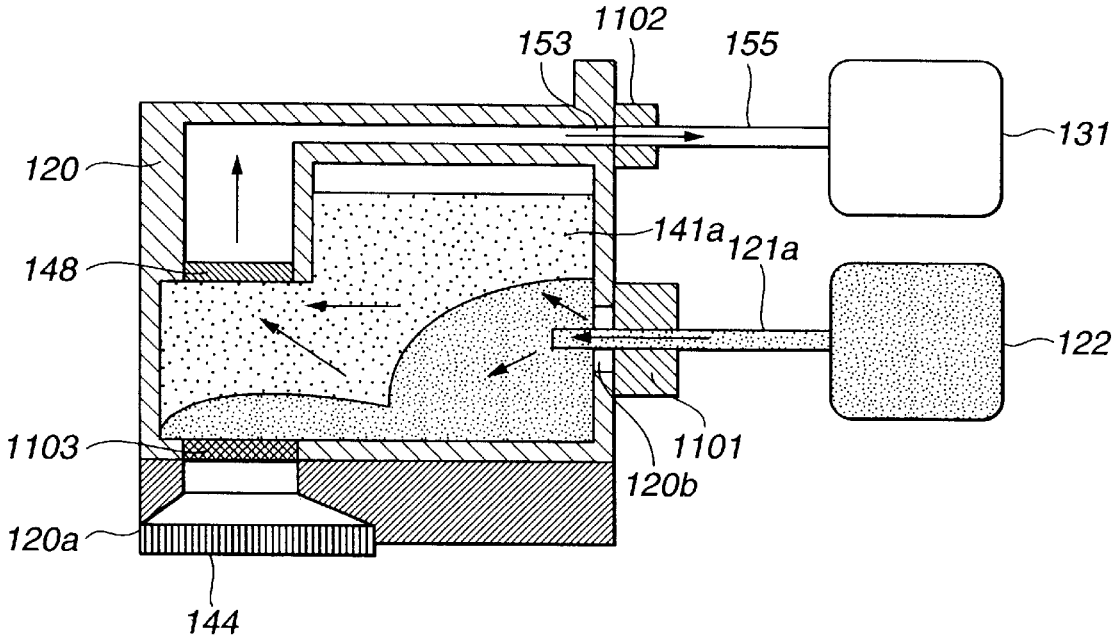
FIGS. 14 and 15 are diagrams, each illustrating a state in which ink is being replenished by the ink replenishing system shown in FIG. 12.
Figure 15:
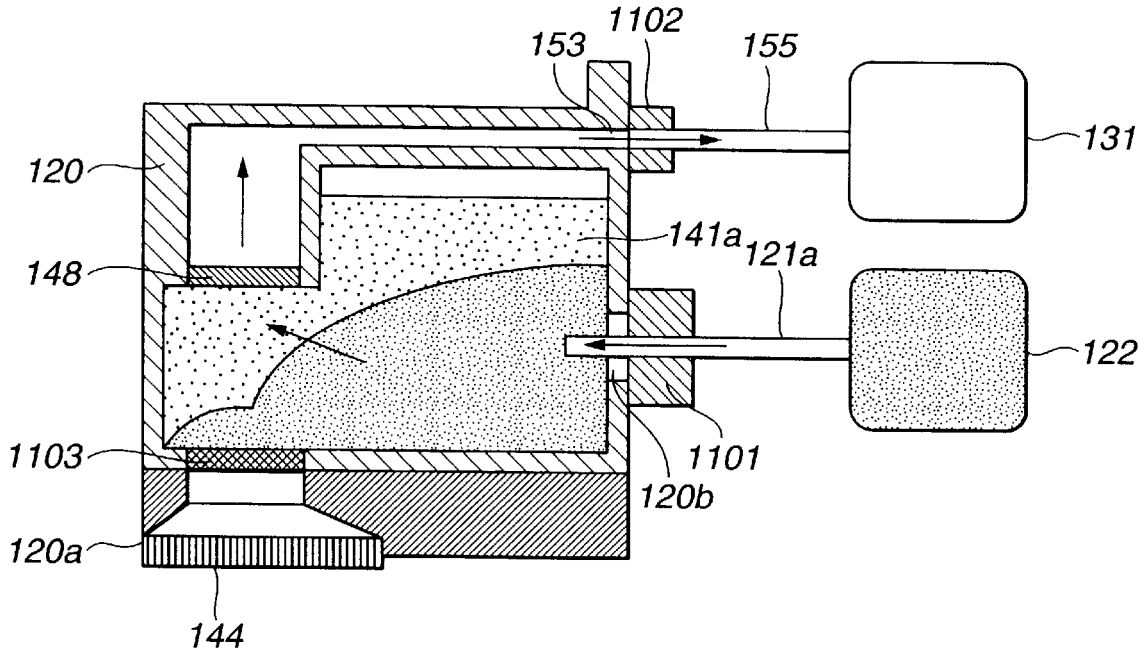
Figure 16:
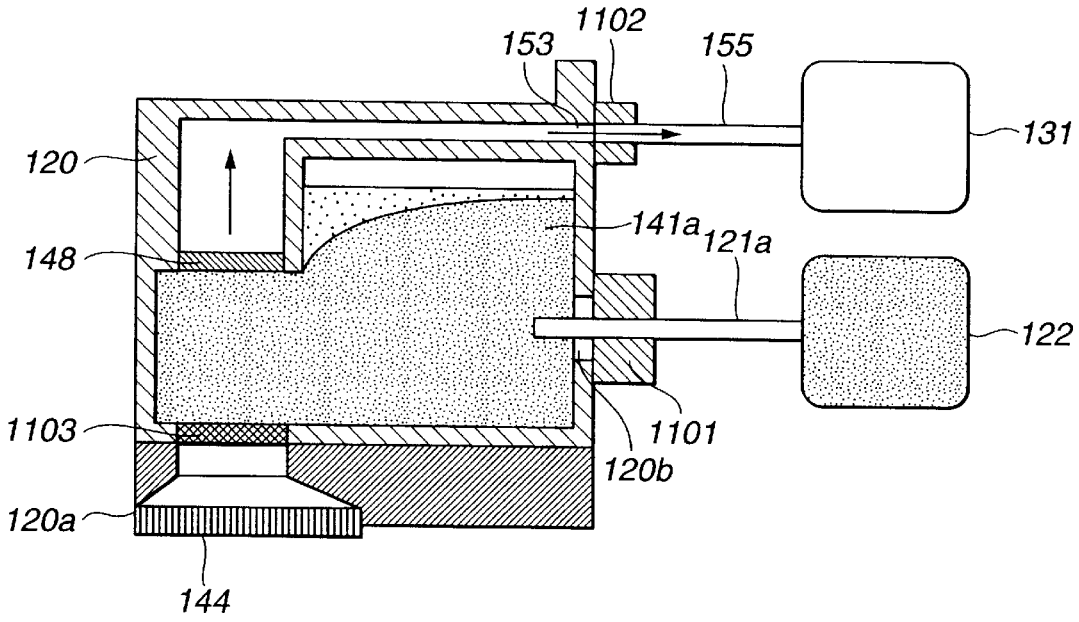
FIG. 16 is a diagram illustrating a state in which ink replenishment by the ink replenishing system shown in FIG. 12 is stopped.
Figure 17:
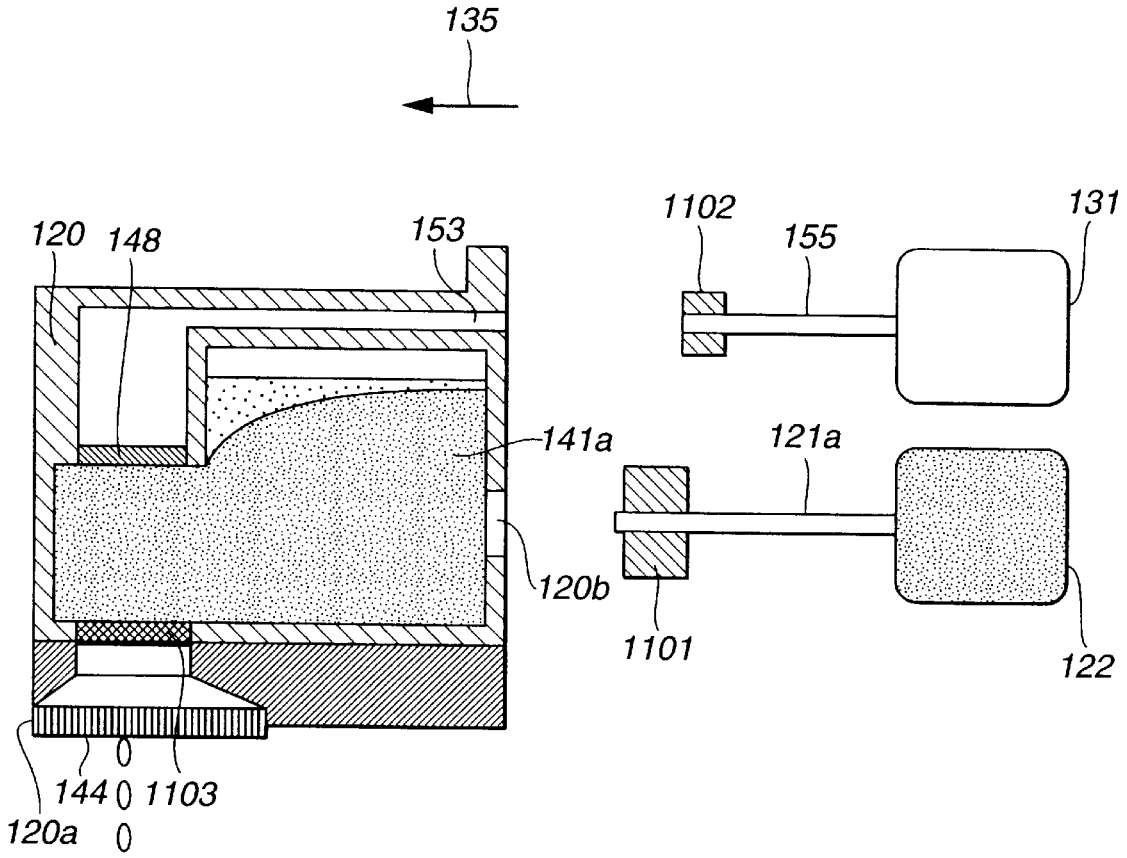
FIG. 17 is a diagram illustrating an operation after completion of ink replenishment by the ink replenishing system shown in FIG. 12.

When replenishing ink, first, as shown in FIG. 13, by the movement of the carriage 119 in the direction of the arrow 128, the ink intake 120*b* and the general suction port 153 are connected to the corresponding joint 1101 and the joint 1102, respectively. Then, by a suction operation of the suction pump 131, air within the storage ink tank 120 is sucked via the gas permeation member 148, to make the pressure within the storage ink tank 120 to be a negative pressure. As shown in FIGS. 14 and 15, ink within the replenishing ink tank 122 is sucked into the inside 141 of the storage ink tank 120. Then, as shown in FIG. 16, when the liquid surface 141*b* of ink within the storage ink tank 120 reaches the gas permeation member 148, replenishment of ink is automatically stopped because the gas permeation member 148 does not allow a liquid, such as ink or the like, to permeate. Then, as shown in FIG. 17, by the movement of the carriage 119 in the direction of the arrow 135, the ink intake 120*b* and the general suction port 153 leave the corresponding joint 1101 and the joint 1102, respectively, and a series of replenishing operation is completed.

Figure 18:
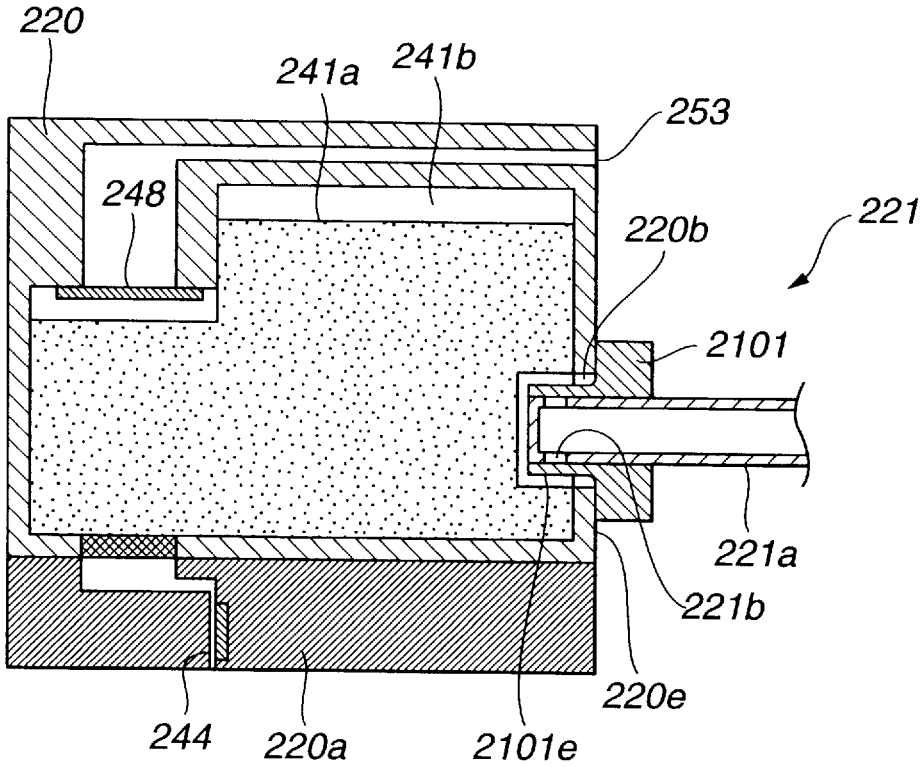
FIG. 18 is a cross-sectional view illustrating a storage ink tank according to a first embodiment of the present invention.
Figure 19:
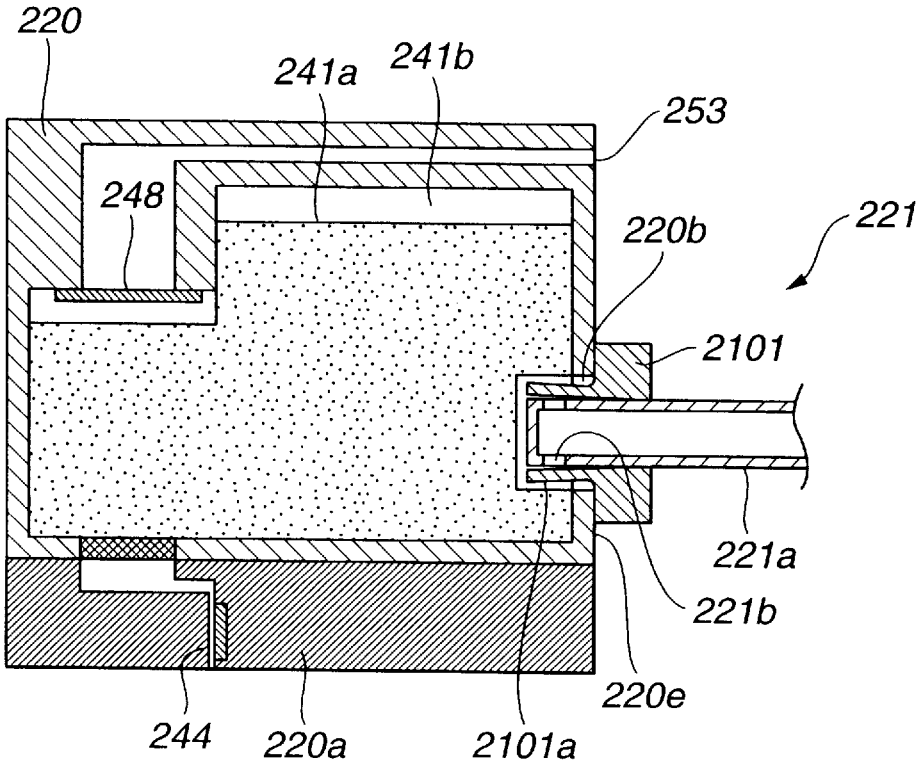
FIGS. 19 and 20 are diagrams, each illustrating a state in which ink is being replenished into the storage ink tank shown in FIG. 18.
Figure 20:
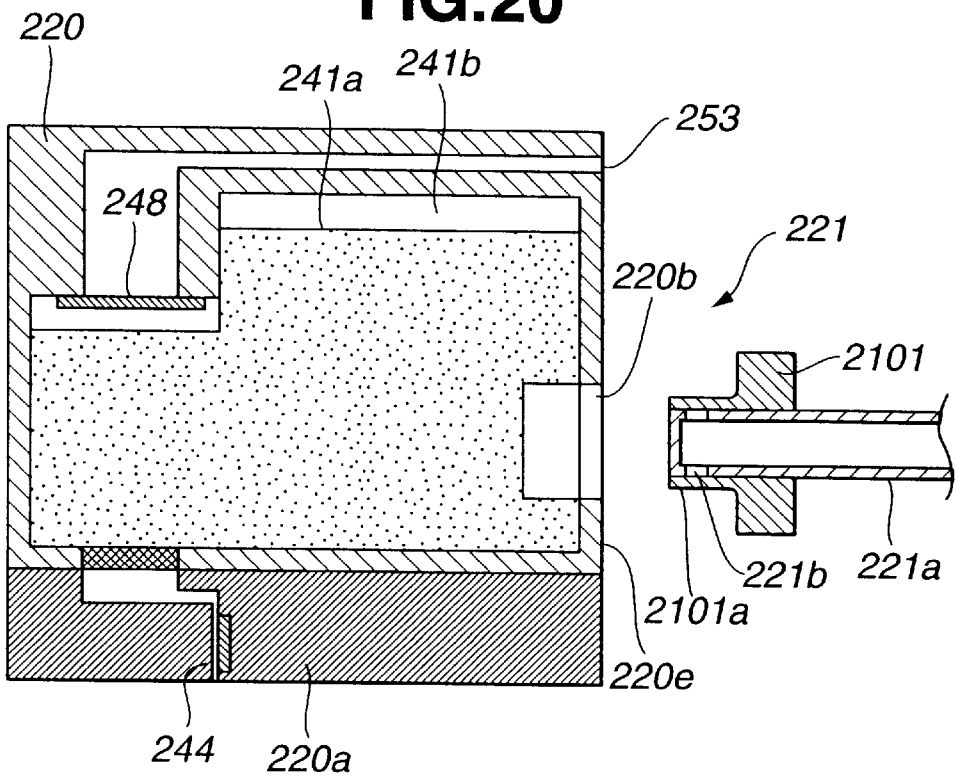
Figure 24:
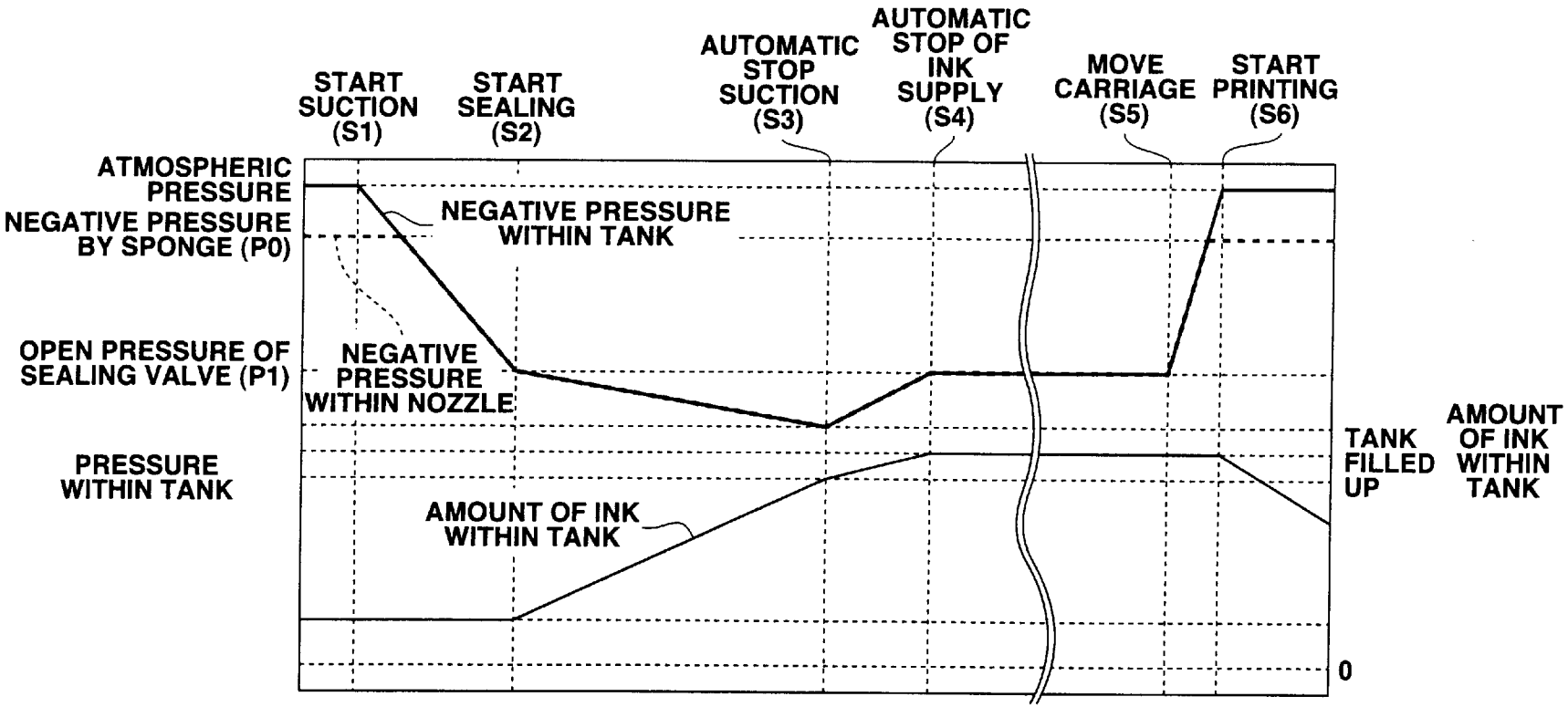
FIG. 24 is a diagram illustrating changes in the pressure and the amount of ink in the storage ink tank according to the present invention.

FIGS. 18 through 20 are diagrams illustrating the state of connection between the storage ink tank 220 and the ink supply means 221 and the operations of the storage ink tank 220 and the ink supply means 221 according to another embodiment of the present invention. FIG. 24 is a diagram illustrating changes in the pressure and the amount of ink within the storage ink tank 220.

When supplying ink, the supply joint 2101 of the ink supply means 221 is connected to a connection surface 220*e* of the storage ink tank 220, so that ink can be supplied. The intake 220*b* provided at the connection surface 220*e* of the storage ink tank 220 is caused to communicate with the ink supply port 221*b* of the ink supply means 221, so that ink can be supplied. At that time, a portion between the connection surface 220*e* of the storage ink tank 220 and the supply joint 2101 is tightly closed. A sealing-valve portion 2101*a* for sealing the ink supply port 221*b* is formed by extending a part of the supply joint 2101. The supply joint 2101 is made of an elastic material, such as rubber or the like, and constricts the hollow needle 221*a* to a degree to open the ink supply port 221*b* when a negative pressure equal to or more than a predetermined set value P1 is applied.

As shown in FIGS. 19 and 24, in step S1, suction is started to provide a negative pressure within the storage ink tank 220 from the suction port 253. When the relationship between the value of the negative pressure P2 within the storage ink tank 220 and the set pressure value P1 becomes P2>P1, then, in step S2, the sealing valve portion 2101*a* is expanded outward from the supply port 221*b* to provide a gap with the sealing valve portion 2101*a*. Ink is supplied from the ink supply means 221 through this gap. When ink supplied to the storage ink tank 220 reaches the gas permeation member 248, then, in step S3, suction is automatically stopped to provide a state in which air within the storage ink tank 220 is not sucked, but ink flows into the storage ink tank 220, so that the negative pressure within the storage ink tank 220 gradually decreases. Then, when the relationship between the value of the negative pressure P2 and the set pressure value P1 becomes P2≦P1 in step S4, the sealing valve portion 2101*a* seals the ink supply port 221*b*, so that ink supply is automatically stopped. In this step S4, the negative pressure within the storage ink tank 220 immediately after ink supply can be set to the predetermined set pressure value P1. Since inflow of ink is stopped before the negative pressure within the storage ink tank 220 assumes the atmospheric pressure, the pressure within the storage ink tank 220 does not become equal to or higher than the atmospheric pressure due to overflow of ink, and it is possible to prevent overflow, leakage and the like of ink.

The generated negative pressure is maintained by air in the space 241*b* within the storage ink tank 220, and has the effect of raising ink within the storage ink tank 220. Accordingly, it is possible to prevent overflow, leakage and the like of ink from the nozzles and the joints in this state. Since the replenishing ink tank 222 is also sealed, the state is not influenced by variations in the pressure generated in the replenishing ink tank 222.

As shown in FIG. 20, when the storage ink tank 220 is separated from the ink supply means 221 from this state, the intake 220*b* of the storage ink tank 220 is opened. By release of the negative pressure remaining in the space 241*b*, air enters from an opening in the joint, and ink accumulated at a portion near the joint is drawn into the sponge 241*a* within the storage ink tank 220. Hence, it is possible to minimize leakage of ink at the joint when the ink supply means 221 is detached and to minimize stains caused thereby. At that time, although the negative pressure within the storage ink tank 220 returns to the atmospheric pressure, the negative pressure within the liquid chambers of the nozzles shifts to a negative pressure P0 generated by the capillary phenomenon in the sponge 241*a* within the storage ink tank 220. That is, by the movement of the carriage 219 in step S5 when starting printing, the remaining negative pressure is released and shifts to the negative pressure by the sponge 241*a*. Hence, during printing in step S6, printing can be performed in a state of an appropriate negative pressure.

Since the ink supply port 221*b* of the ink supply means 221 when leaving the storage ink tank 220 is sealed with the sealing valve member 2101*a*, it is possible to prevent leakage of ink from the ink supply port 221*b* and dryness of ink.

Figure 21:
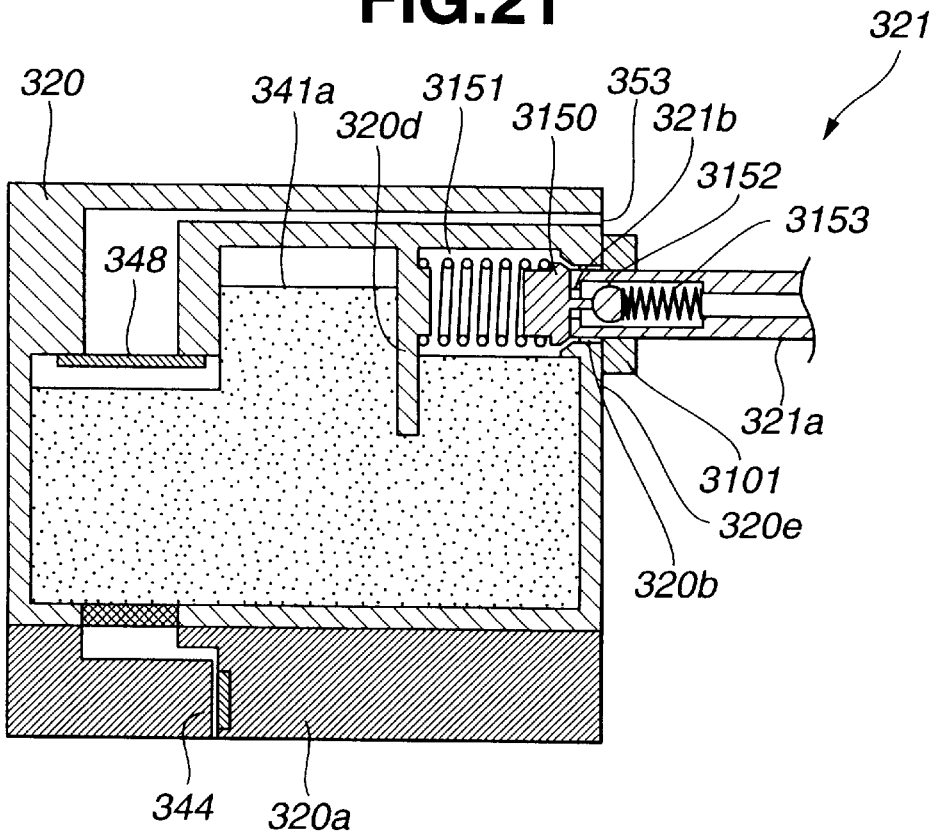
FIG. 21 is a cross-sectional view illustrating a storage ink tank according to a second embodiment of the present invention.
Figure 22:
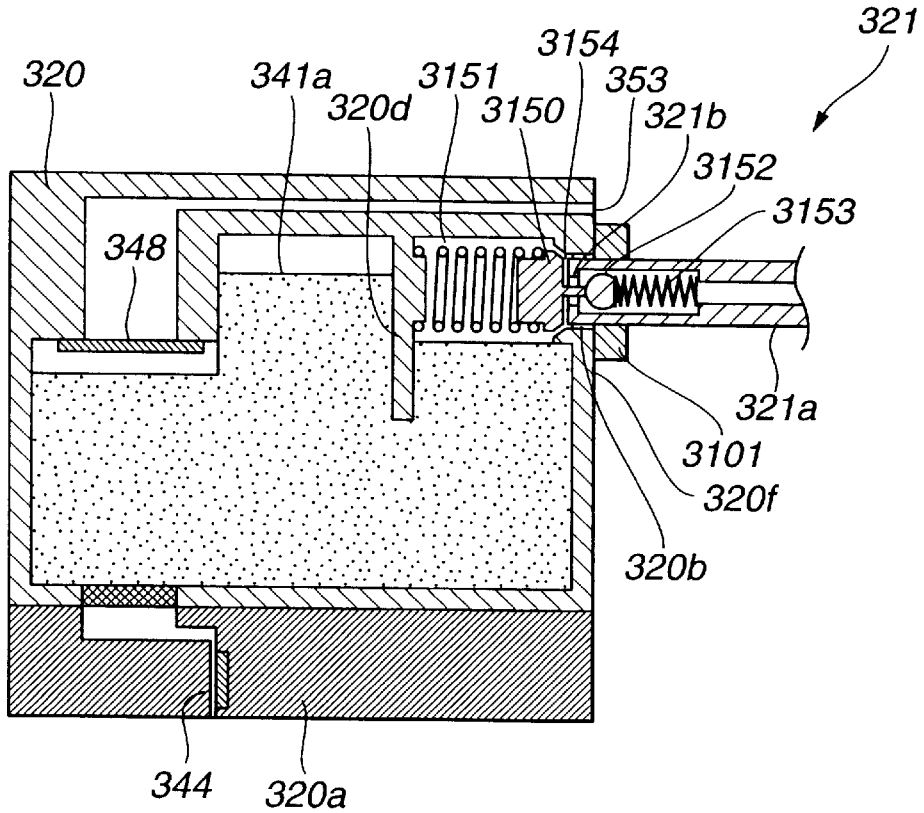
FIG. 22 is a diagram illustrating a state in which ink is being supplied from the storage ink tank shown in FIG. 21.
Figure 23:
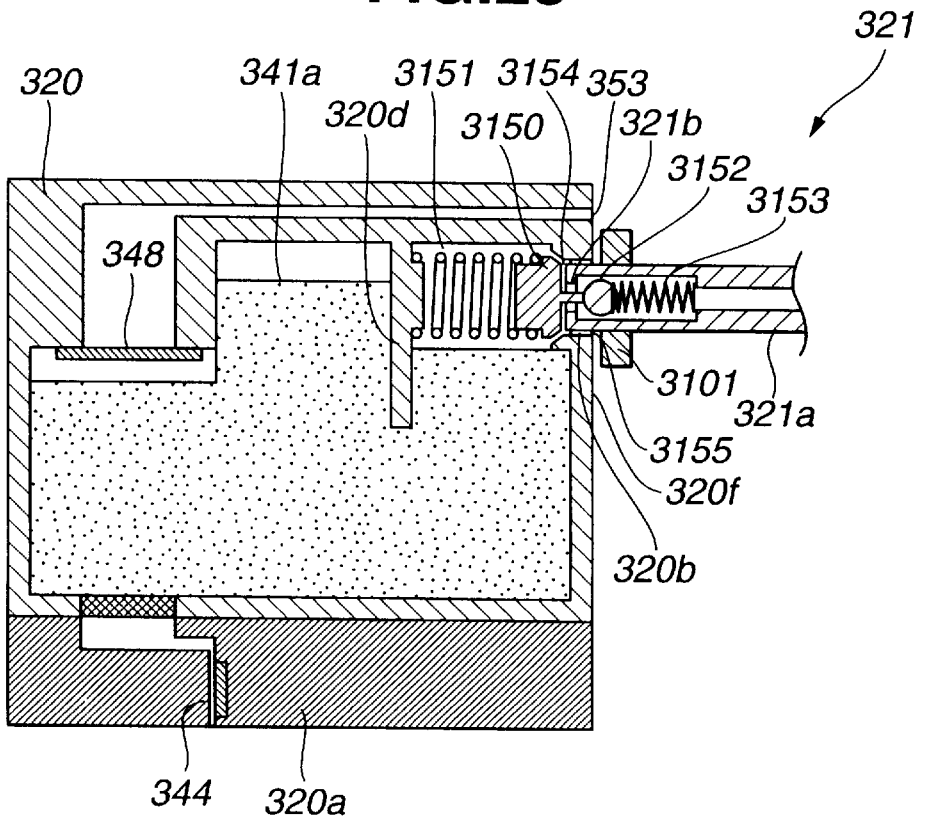
FIG. 23 is a diagram illustrating a state in which ink supply means is separated from the storage ink tank shown in FIG. 21.

FIGS. 21 through 23 are diagrams illustrating another embodiment of the present invention in the ink-jet recording apparatus of the invention.

As in the first embodiment, when supplying ink, the connection surface 320*e* of the storage ink tank 320 is connected to the supply joint 3101 of the ink supply means 321, so that ink can be supplied. A portion between the connection surface 320*e* of the storage ink tank 320 and the supply joint 3101 is tightly closed, and the ink intake 320*b* provided at the connection surface 320*e* of the storage ink tank 320 communicates with the ink supply port 321*b* of the ink supply means 321, so that ink can be supplied. A first sealing valve 3150 is provided near the ink intake 320*b* of the storage ink tank 320, and is urged by a spring 3151 in a direction to seal the ink intake 320*b* with respect to a tank inner surface 320*d* (a rightward direction in FIG. 21). On the other hand, a second sealing valve 3152 is provided at a portion near the ink supply port 321*b* in a hollow needle 321*b*, such as a tube or the like, of the ink supply means 321, and is urged by a spring 3153 in a direction to seal the ink supply port 321*b*. The first sealing valve 3150 is configured so as to be able to open/close the ink supply port 321*b* and the second sealing valve 3152 when the joint 3101 is connected, and has a convex shape.

As shown in FIG. 21, the relationship between the urging force F1 of the spring 3151 and the urging force F2 of the spring 3153 is set to be F1>F2. Accordingly, in a state in which the joint 3101 is connected, the second sealing valve 3152 is opened, but the first sealing valve 3150 seals the ink supply port 321*b*. The urging force F1 of the first sealing valve 3150 is set so as to release sealing when the negative pressure within the storage ink tank 320 becomes equal to or higher than the set value P1.

As shown in FIG. 22, when a negative pressure is provided within the storage ink tank 320 from the suction port 353, and the relationship between the value of the negative pressure P2 within the storage ink tank 320 and the set pressure value P1 becomes P2>P1, a gap 3154 is formed between the first sealing valve 3150 and the ink supply port 321*b*, and ink is supplied from the ink supply means 321 through this gap. The ink moves toward the gas permeation member 348 passing through the distal end of the inner wall 320*d* of the storage ink tank 320. When the ink reaches the gas permeation member 348, a state in which air within the storage ink tank 320 is not sucked but the ink enters is provided. Hence, the negative pressure within the storage ink tank 320 gradually decreases. When the relationship between the value of the negative pressure P2 and the set pressure value P1 becomes P2≦P1, the first sealing valve 3150 seals the ink supply port 321*b*, so that ink supply is stopped. That is, the negative pressure within the storage ink tank 20 immediately after ink supply can be set to the predetermined pressure value P1. Accordingly, as in the first embodiment, it is possible to prevent overflow, leakage and the like of ink from the nozzles and the joints in this state.

As shown in FIG. 23, while the ink supply means 321 is separated from the storage ink tank 320 from this state, the intake 320*b* of the storage ink tank 320 is opened. By thus releasing the remaining negative pressure, air enters from a gap 3155 in the joint 3101, and ink accumulated at a portion near the joint 3101 is drawn into the storage ink tank 320. Hence, it is possible to minimize leakage of ink at the joint 3101 when the ink supply means 321 is separated, and stain. At that time, although the negative pressure within the storage ink tank 320 returns to the atmospheric pressure, the negative pressure within the liquid chambers of the nozzles shifts to a negative pressure P0 generated by the capillary phenomenon in the sponge 341*a*. That is, by the movement of the carriage 319 when starting printing, the remaining negative pressure is released and shifts to the negative pressure by the sponge 341*a*. Hence, during printing, printing can be performed in a state of an appropriate negative pressure.

Since the ink supply port 321*b* of the ink supply means 321 when thereafter completely separated from the storage ink tank 320 is sealed with the second sealing valve 3152, it is possible to prevent leakage of ink from the ink supply port 321*b* and dryness of ink. Since the intake 320*b* of the storage ink tank 320 is sealed by the first sealing valve 3150, it is possible to prevent leakage of ink from the intake 320*b* and dryness of ink. By disposing a tight sealing member, such as an O-ring or the like, at a sealing portion between the intake 320*b* and the first sealing valve 3150, tight sealing can be more assuredly realized. In this case, even if the main body of the recording apparatus is turned upside down in a state in which the carriage 319 stops at an abnormal position, leakage of ink can be prevented.

The ink tank of the present invention is not limited to one which is moved together with the recording head in a serial-scanning-type recording apparatus, but may be provided at a fixed position. Alternatively, the ink tank may be always connected to a replenishing ink tank (sub-ink tank) via a tube.

An ink jet cartridge according to the present invention may have a configuration in which an ink tank and a recording head are integrally or detachably connected.

The present invention may also be applied to a configuration in which a main tank for replenishing ink to an ink tank is always connected to the ink tank via a tube. The present invention may be applied not only to a configuration in which an ink tank moves together with a recording head, but also to a configuration in which an ink tank is provided at a fixed position.

Furthermore, an ink jet recording apparatus according to the present invention may be used as an image output terminal of an information processing apparatus, such as a computer or the like, a copier combined with a reader and the like, a facsimile apparatus having a transmission/reception function, or the like.

As described above, according to the present invention, suction replenishment of ink is automatically stopped utilizing, for example, the function of a gas permeation member, and negative-pressure control means for causing a negative pressure within an ink tank to remain in an ink supply channel from an ink replenishing tank to the inside of the ink tank. Hence, it is possible to assuredly execute replenishment of ink into the ink tank and control of the pressure within the ink tank during ink replenishment with a simple configuration, and thereby reduce the size and the weight of a recording apparatus and improve reliability in the apparatus.

According to the present invention, an ink jet recording apparatus includes an ink tank for receiving ink from an ink intake, ink supply means for receiving ink from a replenishing tank into the ink tank by a negative pressure introduced from a suction port of the ink tank in the inside of the ink tank, and negative-pressure control means for causing the negative pressure within the ink tank to remain in an ink supply channel from the replenishing tank to the inside of the ink tank, so that the negative pressure within the ink tank does not return to an atmospheric pressure while receiving ink. Hence, it is possible to manufacture a device for replenishing ink into an ink tank with a simple configuration, assuredly execute ink replenishment, reduce the size and the weight of a recording apparatus, and improve reliability in the recording apparatus.

In an ink jet recording apparatus according to the present invention, since the negative-pressure control means includes sealing means, provided within the ink tank, for sealing the ink supply channel with a predetermined negative pressure value, it is possible to assuredly perform sealing, and prevent leakage and dryness of ink.

In an ink jet recording apparatus according to the present invention, since the sealing means includes a spring or an elastic member, it is possible to assuredly perform sealing with a simple member, and prevent leakage and dryness of ink.

According to the present invention, an ink jet recording apparatus includes an ink tank for receiving ink from an ink intake, ink supply means for receiving ink via an ink supply channel from a replenishing tank to the inside of the ink tank by a negative pressure introduced from a suction port of the ink tank in the inside of the ink tank, connection means, provided between the ink intake of the ink tank and the ink supply channel, capable of being separated from the ink intake, and negative-pressure control means for causing the negative pressure within the ink tank to remain in the ink supply channel, so that the negative pressure within the ink tank does not return to an atmospheric pressure while receiving ink. Hence, it is possible to manufacture a device for replenishing ink into an ink tank with a simple configuration, assuredly execute ink replenishment, reduce the size and the weight of a recording apparatus, and improve reliability in the recording apparatus.

In an ink jet recording apparatus according to the present invention, since the sealing means includes a spring or an elastic member, it is possible to easily manufacture the apparatus with a low cost, and assuredly prevent leakage and dryness of ink In an ink jet recording apparatus according to the present invention, since the apparatus also includes gas-liquid separation means, provided at the suction port, for allowing a gas to permeate without allowing ink to permeate, it is possible to assuredly prevent penetration of air into the ink tank by separating air, serving as the gas, from ink.

In an ink jet recording apparatus according to the present invention, since the gas-liquid separation means is one of a tetrafluoroethylene resin and a similar porous resin material which allows a gas to permeate without allowing a liquid to permeate, it is possible to preferably manufacture the apparatus using an inexpensive material.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink supply system comprising:

a main tank;

an ink jet head including a subtank;

an ink supply channel which is connected to said main tank and which is connectable to and separable from said subtank;

pressure reduction means which is connectable to and separable from said subtank for reducing the pressure inside said subtank; and an opening/closing mechanism which controls flow of ink from said main tank to said subtank, wherein said opening/closing mechanism opens when a state of pressure reduction inside said subtank is the same as or more than a predetermined threshold and closes when the state of pressure reduction is less than the threshold;

wherein while said ink supply channel and said subtank are connected to each other, said pressure reduction reaches or exceeds the threshold, so that said opening/closing mechanism opens to initiate an ink supply operation from said main tank to said subtank, and while the connection between said ink supply channel and said subtank is maintained, said opening/closing mechanism closes when the state of pressure reduction inside said subtank is reduced to less than the threshold thereby completing the ink supply operation.

2. An ink supply system according to claim 1, wherein said opening/closing mechanism is disposed at a distal end portion of said ink supply channel, the distal end portion being connected to said subtank at a connection portion, and operates so as to open/close an aperture formed at the distal end portion of said ink supply channel and the connection portion in accordance with the state of pressure reduction inside said subtank.

3. An ink supply system according to claim 1, wherein said opening/closing mechanism comprises an elastic rubber valve member which is displaced by negative pressure.

4. An ink supply system according to claim 1, wherein said opening/closing mechanism is disposed at a distal end portion of said ink supply channel, the distal end portion being connected to said subtank at a connection portion, and operates so as to open/close an aperture formed at the distal end portion of said ink supply channel and the connection portion in accordance with the state of pressure reduction inside said sub-tank.

5. An ink supply system according to claim 4, wherein said opening/closing mechanism comprises a sealing member for opening/closing the aperture, and a spring elastic member displaced with the threshold.

6. An ink supply system according to claim 4, wherein a valve mechanism for opening an aperture at a distal end of said ink supply channel by connection of a sealing member of the ink reservoir is provided at the opening.

7. An ink supply system according to claim 1, wherein said suction mechanism is connected to a cap member for covering ink discharging ports provided at the recording head.

8. An ink supply system according to claim 1, wherein said subtank is provided with gas-liquid separation means at a position where said pressure reduction means is connected to said subtank, said gas-liquid separation means allowing a gas to permeate without allowing ink to permeate.

9. An ink jet recording apparatus according to claim 8, wherein said gas-liquid separation means comprises one of a tetrafluoroethylene resin and a similar porous resin material which allows a gas to permeate without allowing a liquid to permeate.

* * * * *